US006908520B2

(12) United States Patent
Taguchi et al.

(10) Patent No.: US 6,908,520 B2
(45) Date of Patent: Jun. 21, 2005

(54) ALUMINUM ALLOY HOLLOW MATERIAL, ALUMINUM ALLOY EXTRUDED PIPE MATERIAL FOR AIR CONDITIONER PIPING AND PROCESS FOR PRODUCING THE SAME

(75) Inventors: Kazuo Taguchi, Tokyo (JP); Toshio Ohta, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 232 days.

(21) Appl. No.: 09/771,309

(22) Filed: Jan. 26, 2001

(65) Prior Publication Data

US 2001/0025676 A1 Oct. 4, 2001

Related U.S. Application Data

(63) Continuation of application No. PCT/JP99/02843, filed on May 28, 1999.

(51) Int. Cl.[7] ..... C22F 1/04
(52) U.S. Cl. ..... 148/689; 148/690
(58) Field of Search ..... 148/689, 690, 148/550

(56) References Cited

U.S. PATENT DOCUMENTS 3,990,922 A * 11/1976 Gullotti et al. ..... 148/11.5
5,286,316 A * 2/1994 Wade ..... 148/550
5,976,278 A * 11/1999 Sircar ..... 148/550

FOREIGN PATENT DOCUMENTS

| | | | |
|---|---|---|---|
| JP | 59-185765 | | 10/1984 |
| JP | 61-052346 A | * | 3/1986 |
| JP | 61-119645 | | 6/1986 |
| JP | 61-119645 A | * | 6/1986 |
| JP | 04-72045 | | 3/1992 |
| JP | 09-263917 | | 10/1997 |
| JP | 11-172388 | | 6/1999 |

OTHER PUBLICATIONS

"ASM Handbook: Desk Edition", 2nd ed, ASM International, 1998, p 428.*
"ASM Specialty Handbook: Aluminum and Aluminum Alloys", ASM International, 1993, p. 68.*

* cited by examiner

*Primary Examiner*—Roy King
*Assistant Examiner*—Janelle Combs Morillo
(74) *Attorney, Agent, or Firm*—Knobbe Martens Olson & Bear LLP

(57) ABSTRACT

Disclosed are aluminum alloy hollow materials and processes for producing the same wherein an aluminum alloy hollow material is produced by subjecting an ingot of an aluminum alloy containing 0.3~1.5 wt % Mn to port hole extrusion or port hole extrusion and drawing-elongation processing and wherein a difference in electric conductivity between individual portions in lengthwise direction of the hollow material is not more than 1.0 IACS %. According to the aluminum alloy hollow materials, preferential corrosion in welding potions in port hole extrusion can be prevented.

17 Claims, 4 Drawing Sheets

Pipe material of example of the present invention (portion with terminal end processing of type B)

Type A

Punch shaping

Type B

Punch shaping

Type C

Punch → forming by rolling

Type D

Punch shaping

Pipe material of example of the present invention (portion with terminal end processing of type B)

Current pipe material (PRIOR ART)

ALUMINUM ALLOY HOLLOW MATERIAL, ALUMINUM ALLOY EXTRUDED PIPE MATERIAL FOR AIR CONDITIONER PIPING AND PROCESS FOR PRODUCING THE SAME

CROSS REFERENCE TO RELATED APPLICATIONS

This application is a continuation under 35 U.S.C. § 120 of prior PCT application No. PCT/JP99/02843, filed on May 28, 1999.

TECHNICAL FIELD

The present invention relates to high corrosion-resisting aluminum alloy hollow materials containing Mn produced according to a port hole extrusion method, which are useful as constructive materials and to a process for producing same.

The present invention relates also to aluminum alloy extruded pipe materials for use as air conditioner piping suited for metal piping portions of a coolant piping, etc. for coolers of automobiles and to a process for producing the aforesaid extruded pipes at a low cost.

BACKGROUND ART

Aluminum hollow materials such as hollow shape materials of square in cross section utilizable for constructive materials and pipes in circle in cross section utilized for a coolant are manufactured from the past according to the port hole extrusion method.

The port hole extrusion method is employed for the manufacture of hollow materials and the like of a relatively soft aluminum alloy, such as JIS 1000 series (pure Al series), 3000 series (Al—Mn series), 6000 series (Al—Mg—Si series), and 7000 series (Al—Zn—Mg series) free from copper.

In the aforesaid port hole extrusion method, an extrusion billet is manufactured by casting a given aluminum alloy according to an ordinary DC casting method (a semi-continuous longitudinal casting method) or a hot top casting method to form an ingot, subjecting the ingot to a homogenizing treatment to reduce segregation, and cutting off the ingot to pieces having a given length.

The extrusion billet is thereafter re-heated by a low frequency induction furnace (induction heater) or a gas-heating furnace and hot extruded to a hollow material. The re-heating temperature is determined by considering extrusion property or quality of the extrusion material within a temperature range of 370~530° C., and 400~500° C. in majority of the cases.

The aforesaid hollow materials manufactured by way of the port hole extrusion may be subjected to a draw-elongation processing for accuracy of dimensions and for reducing the diameter. The drawing-elongation processing includes a method wherein a short hollow material is pulled out by the aid of a draw bench and a method wherein a long hollow material is pulled out by a continuous drawing-elongation machine with the aid of a floating plug. The hollow material after drawing-elongation processing is subjected to a solid solution treatment, an aging treatment, an annealing treatment, etc. for imparting strength and workability thereto according to the intended use.

On the other hand, aluminum alloy pipes are used from the past for heat exchanger pipes of automobiles for the purpose of lightweight.

For example, JIS 6063 alloy (a representative composition: Al—0.5 wt % Mg—0.35 wt % Si) or JIS 3003 alloy (a representative composition: Al—1.0 wt % Mn—0.1 wt % Cu—0.1 wt % Si—0.4 wt % Fe) having corrosion-resistance to external environment and strength tolerant to coolant pressure and vibration of engine or compressor is widely used as coolant pipes for automobile coolers.

The above-mentioned JIS 6063 alloy is used as pipes especially requiring vibration-resisting fatigue strength, the so-called flex hose while the above-mentioned JIS 3003 alloy is widely adopted as a metallic piping portion for automobile coolers, etc.

Pipes comprising JIS 3003 alloy are circular pipes having an outer diameter of about 6~19 mm and a wall-thickness of about 0.8~1.2 mm and their production is carried out, for example, according to the following steps:

First of all, JIS 3003 alloy is cast into a round bar ingot according to a DC semi-continuous longitudinal casting method. The round bar ingot is then subjected to a homogenizing treatment where the ingot is heated at a high temperature to avoid segregation of alloy components and impurities. After cutting off the ingot into pieces of a given length, extruded billets are formed, which are re-heated and subjected to a mandrel extrusion method where extruded pipes are extruded. The extruded pipes are subjected to a drawing-elongation processing by which pipe materials of a desired shape are pulled out and are further subjected to annealing for removing processing strain and furnishing them with a proper workability.

In a conventional manufacturing process, a large size billet having an outer diameter of at least 14 inches is extruded according to a mandrel extrusion method to form a extruded pipe of a large diameter and a thickened wall, which is treated by a continuous drawing-elongation machine to provide multipass drawing-elongation processing.

In passing, the aforesaid homogenizing treatment of ingot has influence on the quality of the final product so that the conditions therefor are determined by considering economic factors such as alloy components, easiness in extrusion processing, required characteristics of product, energy cost for the homogenizing treatment, time, etc.

The conditions (maintained temperature and maintained time) for the homogenizing treatment of a practical aluminum alloy subjected to hot extrusion are briefly as follows:

JIS 1050 alloy: 520~560° C., 4~10 hrs
JIS 1100 alloy: 520~560° C., 4~10 hrs,
JIS 3003 alloy: 570~610° C., 4~10 hrs,
JIS 3004 alloy: 530~580° C., 4~10 hrs,
JIS 6063 alloy: 520~580° C., 4~10 hrs, and
JIS 7NO1 alloy: 450~490° C., 4~10 hrs.

In this case, cooling of the alloy from the maintained temperature to ordinary temperature is carried out by air-cooling with a fan, leaving to stand, sprinkling water by the aid of a sprinkler, etc.

The pipe materials thus manufactured are further subjected to a terminal end processing and a bending processing for the use as cooler pipes for automobiles, etc.

In the above-mentioned terminal end processing of pipe materials, a pipe expanding processing, pipe condensing processing, and forming by rolling are combined to form a variety of beads (joint portion). As a high reliability is required for the beads, a new processing method called shaft seal bead is widely adopted. This shaft seal bead is complicate in shape so that a higher workability is required for pipe materials.

Further, pipes for air conditioner of automobiles require good brazing property and high quality, which is maintained even by heating for brazing.

Aluminum pipe materials for cooler piping still further require strength tolerant to vibration and plastic workability, and a moderate balance of strength and ductility is desired.

For example, the mechanical characteristics of pipes manufactured from JIS 3003 alloy according to mandrel extrusion-drawing elongation-annealing steps are a tensile strength of 95–125 $N/mm^2$, 0.2% yielding strength of at least 35 $N/mm^2$, and an elongation of at least 30%.

Besides, an external pipe surface of the pipes for automobiles requires anti-corrosive property and formability.

The formability requires finely crystalline grains incapable of causing surface roughening at the time of processing, dimensional accuracy such as an outer diameter, a wall-thickness, etc., brazing property, and the like.

With respect to a process for manufacturing aluminum alloy pipes for automobile piping, a process for simplifying steps is now under discussion for reducing cost, wherein the mandrel extrusion is changed to a port hole type continuous extrusion and port hole extrusion pipe materials are directly used as piping materials for a heat exchanger to omit the drawing-elongation processing and annealing step.

Meanwhile, the port hole extrusion method is an extrusion method wherein extrusion raw materials are divided into cleaved bodies with plural port holes and these bodies are welded to an integrated body at the exit of the port holes, thus forming plural welding portions are formed in the longitudinal direction at a given position on the cross section of the extruded materials.

Namely, in case of extrusion with four ports, an aluminum alloy is once divided into 4 cleaved bodies and the cleaved bodies are integrally welded in a welding chamber at an extrusion die and concurrently passed through a clearance between the die bearing portion and the mandrel to form an extruded material of a desired shape so that plural continuous welding portions exist in the lengthwise direction and remain even after the drawing-elongation processing.

When pipe materials of JIS 3003 alloy manufactured according to the port hole extrusion method are exposed to a corrosive environment, however, there arises a problem that the welding portions undergo significant corrosion (referred to hereinafter as the preferential corrosion in the welding portion).

For example, the preferential corrosion of the pipe material obtained according to the port hole extrusion method with 4 port holes is such that as in FIG. 1, a continuous corrosion in the longitudinal direction is preferentially generated in the 4 welding portions, besides corrosions at non-welding portions.

This preferential corrosion in the welding portion is extremely rapid in corrosion velocity so that a penetration hole is formed within a short period of time. In case of subjecting pipes for air conditioners of automobiles having a wall-thickness of 1 mm to the CASS test, for example, pitting corrosion in a non-welding portion is not penetrated even after the lapse of 400 hrs but pitting corrosion in the welding portion is penetrated within 200 hrs.

Concerning this preferential corrosion, the front end portion side of extrusion (the former half portion) tends to become more corrosive than the rear end side portion (the latter half portion). It has become an important technical subject, therefore, that anti-corrosive property is maintained in the welding portion over the full length of the extruded material in the lengthwise direction.

This preferential corrosion of the welding portion easily tends to take place in an Al—Mn series alloy and is generated in case of the Mn content being at least 0.3 wt % and rapidly proceeds in case of the Mn content exceeding 0.8 wt %. By the way, Mn serves to increase deformation resistance while reducing extruding property so that the upper limit of the Mn content in case of the port hole extrusion is around 1.5 wt %.

As the Al—Mn series alloy excels in strength and anti-corrosive property, JIS 3003 (Mn amount 1.0~1.5 wt %), JIS 3203 (Mn amount 1.0~1.5 wt %), and JIS 7N01 (Mn amount 0.2~0.7 wt %) alloys are widely employed. Since hollow materials according to the port hole extrusion involves a problem of the aforesaid preferential corrosion, however, the application of these materials has often refrained from the use where anti-corrosive property is regarded important.

In addition to this, a variety of obstacles such as bad appearance in color tone or luster, etc. takes pace between the welding portion and non-welding portion.

In conventional aluminum alloy pipe materials for air conditioner piping of automobiles, there exist a number of fine striation (confirmed definitely as grooves by enlarged observation) in lengthwise direction formed by the drawing-elongation processing. This striation defect gives damage on sealing property and causes injury of O-ring rubber for sealing. Thus, a drastic solution of this defect is required.

An object of the present invention is to provide a hollow material of an Al—Mn series alloy manufactured according to the port hole extrusion process and improved in preferential corrosion in welding portions. Another object of the present invention is to provide a process for the manufacture of the aforesaid hollow material of an Al—Mn series alloy.

Further, an object of the present invention is to provide extruded pipe materials of aluminum alloys for air conditioner piping, which are improved in anti-corrosive property and fine striation on the surface. Besides, an object of the present invention is to provide a process for manufacturing the aforesaid extruded pipe materials of aluminum alloys for air conditioner piping at a low cost.

The above-mentioned and other objects, features and advantages of the present invention will become more apparent from the following descriptions.

DISCLOSURE OF INVENTION

Figure 1:
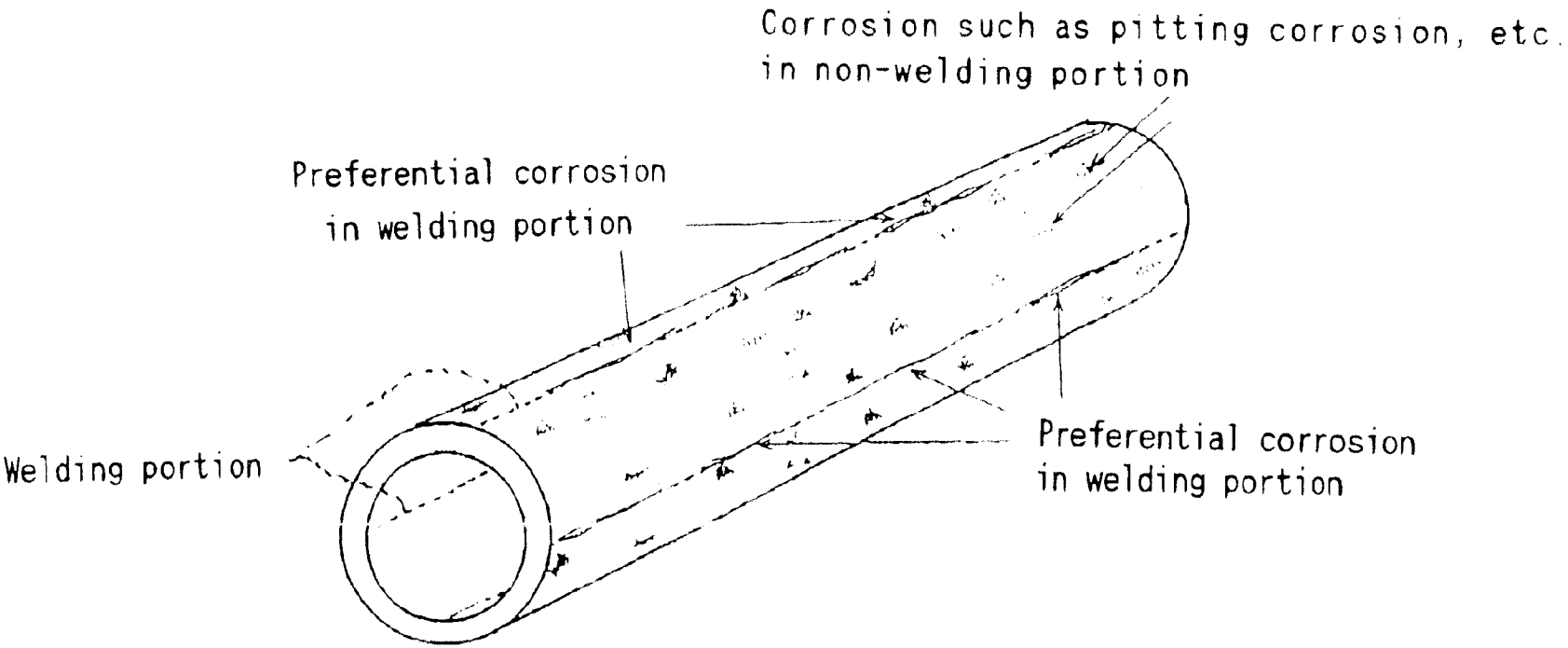
FIG. 1 is an explanatory drawing of preferential corrosion in the welding portion of pipe material manufactured according to the port hole extrusion method.

The present inventors have investigated in detail the above-mentioned preferential corrosion.

As the result, the present inventors have made aware that although a large amount of a Mn-containing compound is precipitated in the process of extrusion, the difference in the precipitated amount between the welding portion and non-welding portion causes the preferential corrosion in the welding portion, and have found that the preferential corrosion in the welding portion can be reduced by previously precipitating a Mn-containing compound with a homogenizing treatment of the ingot before extrusion. The present inventors have further promoted their research and accomplished the present invention.

The present invention provides the following means:

(1) An aluminum alloy hollow material characterized in that the material is produced by subjecting an aluminum alloy ingot containing at least 0.3~1.5 wt % Mn to port hole extrusion or to port hole extrusion followed by drawing-elongation processing, wherein a difference in electric conductivity of individual portions in lengthwise direction of the hollow material is not more than 1.0 IACS %.

(2) A process for producing an aluminum alloy hollow material as set forth in the item (1), wherein an aluminum alloy ingot containing at least 0.3~1.5 wt % Mn is subjected to a homogenizing treatment and thereafter the ingot is subjected to port hole extrusion or port hole extrusion followed by drawing-elongation processing to produce a hollow material, in which the aforesaid homogenizing treatment is carried out by maintaining the ingot at a given temperature of 500~630° C. for 0~24 hours, thereafter cooling the ingot down to another given temperature of 400~500° C. at a cooling velocity of not more than 100° C./hr, and maintaining the ingot at this temperature for 4~48 hours.

(3) A process for producing an aluminum alloy hollow material as set forth in the item (1), wherein an aluminum alloy ingot containing at least 0.3~1.5 wt % Mn is subjected to a homogenizing treatment and thereafter the ingot is subjected to port hole extrusion or port hole extrusion followed by drawing-elongation processing to produce a hollow material, in which the aforesaid homogenizing treatment of the ingot is carried out by maintaining the ingot at a given temperature ($T_1$) of 500~630° C. for 0~16 hrs, thereafter cooling the ingot from the temperature $T_1$ to 350° C. ($T_2$) at a cooling velocity of not more than 100° C./hr, whereby the time from after achieving the temperature $T_1$ to becoming the temperature $T_2$ is maintained within 10~48 hrs, and cooling the ingot at an optional cooling velocity from the temperature $T_2$ to room temperature.

(4) A process for producing an aluminum alloy hollow material as set forth in the item (1), wherein an aluminum alloy ingot containing at least 0.3~1.5 wt % Mn is subjected to a homogenizing treatment and thereafter the ingot is subjected to port hole extrusion or port hole extrusion followed by drawing-elongation processing to produce a hollow material, in which the aforesaid homogenizing treatment of the ingot is carried out by maintaining the ingot at a given temperature of 400~500° C. for 12~48 hours, and thereafter cooling the ingot down to room temperature.

(5) A process for producing an aluminum alloy hollow material as set forth in the item (1), wherein an aluminum alloy ingot containing at least 0.3~1.5 wt % Mn is subjected to a homogenizing treatment and thereafter the ingot is subjected to port hole extrusion or port hole extrusion followed by drawing-elongation processing to produce a hollow material, in which the aforesaid homogenizing treatment of the ingot is carried out by maintaining the ingot at a given temperature of 400~500° C. for 0.5–4 hrs, thereafter elevating the temperature up to another given temperature of 550~630° C., maintaining the temperature for 0.5–4 hrs., thereafter cooling the ingot to 350° C. at a cooling velocity of not more than 100° C./hr, and cooling the ingot from 350° C. to room temperature at an optional cooling velocity.

(The hollow material as set forth in the above item (1) and the processes as set forth in the above items (2)–(5) will be collectively referred to hereinafter as the first invention of the present invention.)

(6) An aluminum alloy extruded pipe material for air conditioner piping characterized in that the material is produced by subjecting an aluminum alloy ingot consisting of 0.8–1.5 wt % Mn, 0.1–0.7 wt % Fe, 0.03–0.6 wt % Si, and 1 or at least 2 of 0.00~0.45 wt % Cu, 0.0~0.3 wt % Mg, 0.0–0.3 wt % Cr, 0.0~0.1 wt % Ti, 0.0~0.5 wt % Zn, 0.0~0.3 wt % Zr, and 0.0~0.3 wt % Ni, the balance being aluminum, and any unavoidable impurities to port hole type continuous hot extrusion method, wherein an electric conductivity of the aforesaid pipe material is at lest 39.0 IACS % (preferably, at least 39.5 IACS %) and a difference in electric conductivity of individual portions in lengthwise direction of the extruded pipe material is not more than 1.0 IACS %.

(7) A process for producing an aluminum alloy extruded pipe material for air conditioner piping wherein an aluminum alloy ingot consisting of 0.8~1.5 wt % Mn, 0.1~0.7 wt % Fe, 0.03~0.6 wt % Si, and 1 or at least 2 of 0.00~0.45 wt % Cu, 0.0~0.3 wt % Mg, 0.0~0.3 wt % Cr, 0.0–0.1 wt % Ti, 0.0~0.5 wt % Zn, 0.0~0.3 wt % Zr, and 0.0~0.3 wt % Ni, the balance being aluminum, and any unavoidable impurities is subjected to a homogenizing treatment and thereafter the ingot is subjected to port hole type continuous hot extrusion method to extrude a pipe material, in which the aforesaid homogenizing treatment of the ingot is carried out by maintaining the ingot at a given temperature of 500~630° C. for 0~24 hrs, thereafter cooling the ingot down to an another given temperature of 400~500° C. at a cooling velocity of not more than 100° C./hr, and maintaining the ingot at this temperature for 4~48 hrs.

(8) A process for producing an aluminum alloy extruded pipe material for air conditioner piping wherein an aluminum alloy ingot as set forth in the item (7) is subjected to a homogenizing treatment and the ingot is subjected to port hole type continuous hot extrusion method to extrude a pipe material, in which the aforesaid homogenizing treatment of the ingot is carried out by maintaining the ingot at a given temperature ($T_1$) of 500~630° C. for 0–48 hrs, thereafter cooling the ingot from the temperature $T_1$ to 350° C. ($T_2$) at a cooling velocity of not more than 100° C./hr, whereby the time from after achieving the temperature $T_1$ to becoming the temperature $T_2$ is maintained within 12~48 hours, and cooling the ingot at an optional cooling velocity from the temperature $T_2$ to room temperature.

(9) A process for producing an aluminum alloy extruded pipe material for air conditioner piping wherein an aluminum alloy ingot as set forth in the item (7) is subjected to a homogenizing treatment and the ingot is subjected to port hole type continuous hot extrusion method to extrude a pipe material, in which the aforesaid homogenizing treatment of the ingot is carried out by maintaining the ingot at a given temperature of 400~500° C. for 12~48 hrs, and thereafter cooling the ingot down to room temperature.

(10) A process for producing an aluminum alloy extruded pipe material for air conditioner piping wherein an aluminum alloy ingot as set forth in the item (7) is subjected to a homogenizing treatment and the ingot is subjected to port hole type continuous hot extrusion method to extrude a pipe material, in which the aforesaid homogenizing treatment of the ingot is carried out by maintaining the ingot at a given temperature of 400~500° C. for 0.5–4 hrs, thereafter elevating the temperature up to another given temperature of 550–630° C., maintaining the temperature for 0.5~4 hrs., thereafter cooling the ingot to 350° C. at a cooling velocity of not more than 100° C./hr, and cooling the ingot from 350° C. to room temperature at an optional cooling velocity.

(The extruded pipe material as set forth in the foregoing item (6) and the processes as set forth in the foregoing items (7)~(10) will be referred to hereinafter collectively as the second invention of the present invention.)

The present invention means to include the first invention and the second invention unless otherwise indicated.

According to the processes as set forth in the items (2)~(5), the hollow material as set forth in the above-mentioned item (1) can be produced by subjecting an aluminum alloy ingot containing a given amount of Mn to the specific homogenizing treatments, respectively, and the hollow material failing to undergo any preferential corrosion in the welding portion formed by port hole extrusion. This hollow material is suitable as constructive material, etc.

Further, according to the processes as set forth in the items (7)~(10), the extruded pipe material as set forth in the item (6) can be produced by subjecting an aluminum alloy ingot specified in the alloy components other than Mn, in place of an aluminum alloy ingot used in the process as set forth in the items (2)~(5), to a homogenizing treatment similar to the method as set forth in the aforesaid items (2)~(5), and the extruded pipe material failing to undergo any preferential corrosion in the welding portion. This pipe material is suitable as pipes for air conditioners.

BEST MODE FOR CARRYING OUT THE INVENTION

First of all, the alloy components of the hollow material and the extruded pipe material of the present invention will be explained below.

Mn is an element contributing to enhancement of strength without damaging anti-corrosive property. In the first invention, the effect is not achieved satisfactorily when the content is less than 0.3 wt %. If the content exceeds 1.5 wt %, its effect is saturated so that deformation resistance at the time of hot processing is increased to reduce the capacity of port hole extrusion. Accordingly, the content is defined within 0.3~1.5 wt % (preferably 0.5~1.3 wt %).

In the second invention, the effect is small if the content of Mn is less than 0.8 wt %. If the content exceeds 1.5wt %, the effect is saturated and simultaneously the deformation resistance at the time of hot processing is increased so that the capacity of port hole extrusion is reduced. Accordingly, the content is defined within 0.8~1.5 wt % (preferably 0.9~1.2 wt %).

In the following, the individual alloy components including the aforesaid Mn are determine in the second invention, considering that strength, anti-corrosive property, workability, and the like necessary for materials of air conditioner piping for automobiles are secured and port hole extrusion is facilitated.

Fe and Si are contained in a minor amount in ordinary aluminum alloys. These elements exhibits the effect that the amount of solid solution of Mn is decreased and simultaneously these elements form inter-metallic compounds with Al at the time of casting to make the recrystalized structure minimized so that it is preferable that Fe and Si are moderately contained. In case Fe exceeding 0.7 wt % or Si exceeding 0.6 wt % is contained, however, an enormous inter-metallic compound is formed to deteriorate formability and anti-corrosive property. Accordingly, the contents of Fe and Si are 0.1~0.7 wt % (preferably 0.2~0.6 wt %) and 0.03~0.6 wt % (preferably 0.03~0.3 wt %), respectively.

Cu contributes to enhancement of strength. Cu making solid solution with the base alloy also contributes to rendering natural electric potential noble to improve anti-corrosive property more or less. In case Cu exceeding 0.45 wt % is contained, however, a compound containing Cu is selectively precipitated on grain boundary in the course of extrusion, etc. so that corrosion on the grain boundary is increased and port hole extruding property is lowered. Accordingly, the content of Cu is 0.0~0.45 wt % (preferably 0.0~0.25 wt %).

Mg contributes to increase strength by making solid solution, but extremely increases deformation resistance while hot working so that if Mg in addition to Mn is added in an amount exceeding 0.3 wt %, port hole extruding property is lowered. Thus, the content of Mg is 0.0~0.3 wt % (preferably 0.0~0.1 wt %).

Cr is effective for minimizing crystal structure, but its content exceeding 0.3 wt % forms a coarse Al—Cr compound to damage formability. Accordingly, the content of Cr is 0.0~0.3 wt % (preferably 0.0–0.05 wt %).

Ti contained in a very small amount serves to minimize crystal structure. In case its content exceeding 0.1 wt % lowers extruding property and forms an enormous inter-metallic compound harmful for formability. Accordingly, the content of Ti is 0.0~0.1 wt % (preferably 0.0–0.05 wt %).

By Zn is expected the effect of increasing strength more or less. If Zn is contained in a large amount, it induces deterioration of anti-corrosive property. Thus, the content of Zn is 0.0~0.5 wt % (preferably 0.0~0.1 wt %).

Zr is effective to minimize crystal structure, but its addition in a large amount deteriorates extruding property and formability. Accordingly, the content of Zr is 0.0~0.3 wt % (preferably 0.0~0.05 wt %).

Ni has more or less effect for increasing strength, but its addition in a large amount deteriorates extruding property and formability. Accordingly, the content of Ni is 0.0~0.3 wt % (preferably 0.0~0.05 wt %).

The phrase that the content of an alloy component is 0 wt % means herein that the alloy component is not contained at all.

An aluminum alloy used in extruded pipe materials of the second invention contains one or at least two elements selected from a group consisting of Cu, Mg, Cr, Ti, Zn, Zr and Ni in addition to the contents in given amounts of Mn, Fe and Si, the balance being Al and unavoidable impurities.

An aluminum alloy consisting of the above-mentioned components fully enables extrusion to pipe materials for air conditioners of a given shape. Further, the aforesaid aluminum alloy affords in the process of extrusion (just after taken out from the die) a homogeneous very fine recrystalized structure, strength, and ductility similar to those of pipe materials obtained by annealing the conventional drawn pipe.

In the present invention, the reason why the electric conductivity of individual portions over the full length in lengthwise direction of the extruded pipe material is defined as the electric conductivity of the extruded pipe material and why the difference in electric conductivity (the difference between the maximum value and the minimum value of the conductivity) in lengthwise direction of individual pipe material portions is defined in the second invention is to avoid preferential corrosion in the welding portion.

The present inventors have been aware of the cause of generating preferential corrosion in the welding portion as follows:

In DC casting or hot top casting, after solidification, the cast article is immediately cooled with water to effect quenching so that the majority of Mn exists in aluminum solid phase in the form of solid solution. In a homogenizing treatment applied to cast ingot, the treatment is carried out by maintaining the ingot at a high temperature near the solidus line temperature for the purpose of solving of micro-segregation, dividing of crystallized substance, sphering, etc. so that Mn is not so precipitated. In the cooling step after maintenance of a high temperature, the cooling rate is relatively high so that Mn is scarcely precipitated also here. In this instance, the cast ingot is subjected to the subsequent re-heating and extrusion step irrespective of whether the homogenizing treatment is carried out or not.

By the way, Al—Mn series compound, Al—(Fe, Mn) series compound, Al—(Fe, Mn)—Si series compound, etc. are precipitated as Mn-containing compounds.

In usual, the extrusion temperature is about 400~500° C., but this temperature range is a temperature at which Mn in the state of super-saturated solid solution is easily precipitated. It is already made clear by the investigation of the present inventors that the precipitation velocity at the time of extrusion processing becomes extremely large due to acceleration of the precipitation by the processing.

Namely, in the process where large strain is continuously imparted as in extrusion processing, diffusion of alloy elements is extremely accelerated so that the precipitation of compounds is also accelerated.

For example, extrusion time of a billet having a length as well as several ten cm is at most several minutes, however during this several minutes, precipitation is promoted extremely. As the rear end portion side of the billet undergoes strain for a long period of time, a precipitation amount becomes larger than in the front end side of extrusion. In case the processing is not accompanied, a compound containing Mn is scarcely precipitated during the heating for even the same several minutes.

Inherently, the diffusion velocity of a transition metal such as Mn or the like in Al is extremely small, but the precipitation of Mn (dynamic precipitation phenomenon) is extremely promoted by imparting strain continuously.

The fact that precipitation of Mn-containing compounds becomes much in the latter half of extrusion can be confirmed by both of the observation with a transmission electron microscope and the measurement of electric conductivity. Namely, the electric conductivity is higher as the precipitation amount becomes larger. The electric conductivity of extruded materials of a Mn-containing aluminum alloy tends to increase from the front end side to the rear end side. Its difference is usually at least 2 IACS %.

As stated above, precipitation of Mn-containing compounds is more promoted in the rear end portion side of the extrude pipe material. In case extrusion of a plurality of billets continuously, a difference in structure is formed between the welding portion and non-welding portion according to the following mechanism.

Namely, in the process of a continuous extrusion of an aluminum alloy with a port hole die, the aluminum alloy of a first billet remaining in a gap between a port hole of the die and a welding chamber after completion of the extrusion of the first billet exists in the rearmost end of extrusion and is most promoted in precipitation of Mn and a second billet higher in the degree of Mn solid solution is adjacently arranged by extrusion. Extrusion of the second billet is initiated in this state. At the earliest period of extruding the second billet, the aluminum alloy of the first billet remaining in the welding chamber and the port hole is excluded and consequently the aluminum alloy of the second billet is excluded to non-welding portion, thus gradually increasing a portion occupied by the second billet.

In a portion replacing the billets, the welding portion of the extruded material is formed by the aluminum alloy at the rear end of the preceding billet, while the non-welding portion is formed by the aluminum alloy of the subsequent billet. This construction continues until completion of the extrusion of the subsequent billet while narrowing the width of the welding portion.

As described above, precipitation proceeds during extrusion so that precipitation also proceeds in the non-welding portion at the latter half stage of extrusion, minimizing the difference in precipitation state between the welding portion and the non-welding portion. This construction is similar in case of the extruded articles being increased.

Thus, a pattern where precipitation of a Mn-containing compound is abound in the welding portion, while in the non-welding portion, a degree of solid solution of Mn is relatively high, is remarkable at the front end side of extrusion. Here, comparison made between electrochemical properties of both portions shows that the welding portion where precipitation of the Mn-containing compound proceeds is base in electric potential so that the welding portion is sandwiched between the non-welding portions where the electric potential is noble, thus resulting in that the welding portion undergoes preferentially potential corrosion to cause corrosive obstacles under corrosive environment.

The present inventors have considered that prior to extrusion, to minimize a difference in the amount of solid solution of Mn between the front end side and the rear end side of the extrusion billet is effective for preventing the preferential corrosion of the welding portion, and have accomplished the invention.

In order to minimize the difference in the amount of solid solution of Mn, the present inventors have found that it is effective to allow the Mn-containing compounds to precipitate in the course of the homogenizing treatment. Namely, in case of an ingot where precipitation of the Mn-containing compounds already proceeds, excessive proceeding of the precipitation does not proceed in the extrusion step. In case the homogenizing conditions are regulated to precipitate the Mn-containing compounds moderately, a great difference in electric potential is not formed between the front end portion side and the rear end portion side or between other portions, and moreover corrosion of the welding portion is dramatically inhibited.

In the second invention, in an extruded material where an inhibitory effect of preferential corrosion in the welding portion is apparent, electric conductivities at all individual portions of the extruded material are at least 39.0 IACS %, preferably at least 39.5 IACS %, respectively. In other words, the preferential corrosion in the welding portion cannot be inhibited sufficiently unless all individual portions in lengthwise direction of the extruded material attain at least 39.0 IACS %.

It is ideal that the state of precipitation of the Mn-containing compounds in the extruded material is wholly equivalent from the front end to the rear end of the extruded material. Actually, however, a minor difference in the state scarcely permits selective corrosion in the welding portion. This permissible difference is, as described above (the aforesaid items (1) and (6)), not more than 1.0 IACS % in terms of difference in electric conductivity, preferably not more than 0.6 IACS %, for obtaining high confidence to anti-corrosive property.

In the present invention, the term, the difference in electric conductivity in the individual portions of the hollow materials or the extruded pipe materials, means a difference between a maximum value and a minimum value in electric conductivity of the whole samples cut off in lengthwise direction from the hollow materials or the pipe materials.

Well, in extruded billets where a large amount of the Mn-containing compounds have finely been precipitated, this fine precipitate makes solid solution with the base at the initially beginning stage of extrusion so that it is necessary to allow the precipitate to precipitate coarsely. In order to control the precipitation of this coarse Mn-containing compounds, the conditions for the homogenizing treatment are stated in the foregoing items (2)~(5) and in the foregoing items (7)~(10).

According to the processes stated in the foregoing items (2) and (7), the ingot is at the outset maintained at a given relatively high temperature of 500~630° C. for 0~24 hours and thereafter cooled at a cooling velocity of not more than 100° C./hr. The Mn-containing compounds precipitated in the course of the temperature elevation process and in the course of the maintenance process in this heat treatment grow relatively coarsely in the course of the cooling. Here, in case the cooling velocity becomes higher than 100° C./hr, a large amount of a precipitate is freshly precipitated, but this precipitate is very fine so that it easily tends to make a solid solution again as described above. It is difficult to get a more rapid cooling velocity for cooling in a furnace, and it is not realistic in the viewpoint of industry. A cooling velocity of not more than 50° C./hr is especially preferable. Thereafter, the ingot is maintained at a temperature within the range of 400~500° C. Among the Al—Mn series alloys, the Mn-containing compounds tend to be most easily precipitated within this temperature range and the precipitated amount is further increased during this maintenance process. At least 4 hours of the maintenance time at the aforesaid temperature is necessary for increasing the precipitated amount. The precipitating effect is saturated and becomes not economical in case of the maintenance time exceeding 48 hrs. and so 48 hrs. is set as the upper limit.

The aforesaid processes as set forth in the items (2) and (7) are a method wherein an ingot is maintained at a high temperature and then gradually cooled to create an adequate precipitation state and thereafter the temperature is maintained within a range where the precipitation is most easy to increase the precipitated amount. Contrary to this, the processes as set forth in the items (3) and (8) are a method wherein precipitation is allowed to proceed only by gradual cooling process from a high temperature. The reason why the cooling velocity has to be not more than 100° C./hr in this method is same as in the foregoing items (2) and (7). During the gradual cooling process from $T_1$ (500~630° C.) to $T_2$, the reason why the temperature $T_2$ has to be set as 350° C. is that the Mn-containing compounds scarcely precipitate at a temperature less than 350° C. so that there is no meaning to limit the cooling velocity. In this treatment conditions, what is influenced on the precipitated amount and the precipitating state is chiefly the process from the time of arrival at 500~630° C. ($T_1$) to the time of becoming at 350° C. ($T_2$). In case the time of this process is short, it will be hard to get the desired precipitation state. In case the time is too long, however, the effect will be saturated to become less economical. Thus, the time from arrival at the temperature $T_1$ to getting to the temperature $T_2$ is defined as 12~48 hrs.

The processes as set forth in the foregoing items (4) and (9) are a method for increasing the amount of precipitate by maintaining the temperature for a long period of time at 400~500° C., which temperature permits the highest proceeding of the precipitation.

In case an ingot having a high degree of super saturation is maintained within this temperature range, a very fine precipitate is initially precipitated and thereafter the precipitate becomes coarse.

In case the treating time is less than 12 hrs., the majority of the precipitate is very fine and easily become solid solution again. In case the treating time exceeds 48 hrs., increase in the precipitated amount is saturated to become less economical. Thus, the maintenance time is defined as 12~48 hrs.

The processes as set forth in the foregoing items (5) and (10) is a method wherein a large amount of the very fine precipitates are allowed to precipitate by maintaining a given temperature of 400~500° C., then very fine precipitates are made coarse during the process of maintaining the precipitates at a given temperature of 550~630° C. and gradually cooling the precipitates to 350° C.

A given temperature of 400~500° C. is maintained for the purpose of forming very fine precipitates. The holding time is defined as a short period of time as well as 0.5~4 hrs. In case the ingot is maintained at a given temperature of 550~630° C. for a long time, a very fine precipitate functioning as a nucleus disappears so that the holding time is also set as a short period of time as well as 0.5~4 hrs.

A cooling velocity after holding the ingot at a given temperature of 550~630° C. is set as not more than 100° C./hr effective for dimensional enlargement of the already existing precipitate. The reason why the cooling velocity is limited down to 350° C. is that the precipitation scarcely takes place at a temperature lower than 350° C.

According to the present invention, an aluminum alloy hollow material can be obtained, which material is devoid of a difference in structure (precipitation amount of Mn, etc.) between the welding portion and the non-welding portion and is prevented from preferential corrosion in the welding portion. The aforesaid hollow material can easily be manufactured by applying a given homogenizing treatment to the ingot to precipitate Mn as a coarse compound.

According to the present invention, an aluminum alloy port hole extruded pipe material for air conditioner piping can also be obtained, which material is improved in preferential corrosion in the welding portion. The aforesaid extruded pipe material can easily be manufactured by applying a given homogenizing treatment to the ingot to precipitate a compound containing an alloy element Mn coarsely.

EXAMPLE

The present invention will be explained in more detail with reference to the examples, but the present invention is not limited by these.

Example 1

Alloy Nos. 1~8 of the compositions shown in Table 1 were subjected to DC casting method to cast round bar ingots of 6 inches in outer diameter for extrusion. Among them, the alloy ingots of Nos. 1~5 and 8 were heated at 600° C. for 4 hrs. then cooled in furnace down to 350° C. at a cooling velocity of 30° C./hr, and thereafter taken out from the furnace and cooled by sprinkling water with the aid of a sprinkler. The alloy ingots of Nos. 6 and 7 were heated at 585° C. for 4 hrs., then cooled down to 350° C. at a cooling velocity of 30° C./hr in furnace, and then taken out from the furnace and cooled by sprinkling water with the aid of a sprinkler.

Example 2

Alloy Nos. 1~8 of the compositions shown in Table 1 were subjected to DC casting method to cast round bar ingots of 6 inches in outer diameter for extrusion. The resultant alloy ingots were heated at 530° C. for 6 hrs., then cooled down to 350° C. at a cooling velocity of 30° C./hr in furnace, and then taken out from the furnace and cooled by sprinkling water with the aid of a sprinkler.

Comparative Example 1

Alloy Nos. 1~8 of the compositions shown in Table 1 were subjected to DC casting method to cast round bar ingots of 6 inches in outer diameter for extrusion. Among them, the alloy ingots of Nos. 1~5 and 8 were heated at 600° C. for 16 hrs., then quickly transported out of the furnace and cooled by sprinkling water with the aid of a sprinkler at a cooling velocity exceeding 100° C./hr. The alloy ingots of Nos. 6 and 7 were heated at 585° C. for 8 hrs., then quickly transported out of the furnace and cooled by sprinkling water with the aid of a sprinkler at a cooling velocity exceeding 100° C./hr.

The ingots manufactured by the steps according to Examples 1 and 2 and Comparative Example 1 were cut off at a given length to prepare extrusion billets, which were extruded according to port hole extrusion method to form hollow materials of a regular square in cross section having a side of 12.0 mm and a wall-thickness of 1.40 mm. The number of extruded articles of the hollow materials was 1, the port holes was 2 and the welding portions were in the central part of the respective opposing sides. The extrusion billets were re-heated up to 440° C. by the aid of an induction heater and the extruded article was compulsorily cooled with a fan. The 3 extrusion billets were prepared for individual alloys and were continuously extruded.

The hollow shape material corresponding to the third extrusion billet is provided for various evaluations. As a portion up to 5 m from the head of the hollow material was mixed abound with the subsequent billet portion, this portion was excluded and sampling was made from the remaining portion. Each sample was measured for electric conductivity according to the four-terminal method and a difference in electric conductivity ΔEC between the front end portion side and the rear end portion side of the hollow material was obtained.

The aforesaid samples were also subjected to the CASS test (JIS-H-8681) conducted for 200 hrs. whereby the state of preferential corrosion in the welding portion after the test was visually observed to evaluate the state in three grades (A: no preferential corrosion, B: some preferential corrosion, and C: serious preferential corrosion). In case a difference existed between the front end portion side and the rear end portion side of the hollow material, a portion where preferential corrosion was serious was made an object for evaluation. The results are shown in Table 2.

TABLE 1

| Section | Alloy No. | Si | Fe | Cu | Mn | Mg | Cr | Zn | Ti | Balance |
|---|---|---|---|---|---|---|---|---|---|---|
| Example of the present invention | 1 | 0.16 | 0.28 | 0.00 | 1.36 | 0.00 | 0.00 | 0.00 | 0.01 | Al |
| | 2 | 0.18 | 0.30 | 0.00 | 0.88 | 0.00 | 0.00 | 0.00 | 0.02 | Al |
| | 3 | 0.16 | 0.26 | 0.00 | 0.60 | 0.00 | 0.00 | 0.00 | 0.01 | Al |
| | 4 | 0.15 | 0.27 | 0.00 | 0.31 | 0.00 | 0.00 | 0.00 | 0.01 | Al |
| | 5 | 0.25 | 0.46 | 0.14 | 0.93 | 0.00 | 0.00 | 0.00 | 0.01 | Al |
| | 6 | 0.37 | 0.22 | 0.00 | 0.95 | 0.51 | 0.00 | 0.00 | 0.02 | Al |
| | 7 | 0.20 | 0.61 | 0.12 | 1.12 | 1.05 | 0.00 | 0.00 | 0.01 | Al |
| | 8 | 0.18 | 0.25 | 0.31 | 0.76 | 0.00 | 0.00 | 0.00 | 0.01 | Al |

(Remarks) Unit: wt %

TABLE 2

| Classification | Alloy No | Conditions of homogenizing treatment | Difference in electric conductivity between the front and rear end portions of extrusion IACS % | The state of generating preferential corrosion CASS |
|---|---|---|---|---|
| Example of the present invention (Example 1) | 1 | 600° C. × heating for 4 hrs. and cooling in furnace → 350° C. cooling by sprinkling water | 0.8 | A |
| | 2 | | 0.6 | A |
| | 3 | | 0.7 | A |
| | 4 | | 0.2 | A |
| | 5 | | 0.6 | A |
| | 6 | 585° C. × heating for 4 hrs. and cooling in furnace → 350° C. cooling by sprinkling water | 0.8 | A |
| | 7 | | 0.7 | A |
| | 8 | 600° C. × heating for 4 hrs. and cooling in furnace → 350° C. cooling by sprinkling water | 0.6 | A |

TABLE 2-continued

| Classification | Alloy No | Conditions of homogenizing treatment | Difference in electric conductivity between the front and rear end portions of extrusion IACS % | The state of generating preferential corrosion CASS |
|---|---|---|---|---|
| Example of the present invention (Example 2) | 1 | 530° C. × Heating for 6 hrs. and cooling in furnace → 350° C. Cooling by sprinkling water | 0.7 | A |
| | 2 | | 0.5 | A |
| | 3 | | 0.5 | A |
| | 4 | | 0.4 | A |
| | 5 | | 0.8 | A |
| | 6 | | 0.7 | A |
| | 7 | | 0.7 | A |
| | 8 | | 0.6 | A |
| Comparative example (Comparative example 1) | 1 | 600° C. × Heating for 16 hrs. and cooling by sprinkling water | 3.4 | C |
| | 2 | | 3.1 | C |
| | 3 | | 2.6 | C |
| | 4 | | 2.1 | B |
| | 5 | | 3.2 | C |
| | 6 | 585° C. × Heating 8 hrs. and cooling by sprinkling water | 2.8 | C |
| | 7 | | 3.1 | C |
| | 8 | 600° C. × Heating 16 hrs. and cooling by sprinkling water | 2.8 | C |

(Remarks)
A: No preferential corrosion generated in the welding portion.
B: Some preferential corrosion was recognized in the welding portion.
C: Apparent preferential corrosion was recognized in the welding potion.

From Table 2, it is understood that all of the examples of the present invention attained ΔEC of not more than 1.0 IACS % and the difference in the precipitation amount of Mn between the front end portion side and the rear end portion side of the hollow material was scarce. In all of the cases, the electric conductivity was greater in the rear end side than in the front end side in each billet extruded. No preferential corrosion was detected in the welding portion of each material.

This is due to that Mn was precipitated coarsely in the homogenizing treatment of the ingot.

Contrary to this, ΔEC exceeded 1.0 IACS % and the electric conductivity was higher in the rear end side than in the front end side in all of Comparative Examples.

This is due to that the materials in which a large amount of Mn was made into the state of solid solution was extruded so that a difference in the precipitation amount of Mn was formed between the front end and the rear end of extrusion.

In the CASS test, Table 2 shows a result of evaluation of the front end portion side where the state of corrosion was serious.

Among the corrosion in the welding portion evaluated as C rank, there contained the case wherein the corrosion was penetrated in spite of the wall thickness being as thick as 1.4 mm.

Example 3

A round bar ingot for extrusion having an outer diameter of 6 inches was cast according to DC casting method from the alloy No. 2 having the composition shown in Table 1. This alloy ingot was heated at 610° C. for 8 hrs. then cooled down to 350° C. at a cooling velocity of 25° C./hr and thereafter taken out from the furnace and cooled by sprinkling water with the aid of a sprinkler.

Example 4

A round bar ingot for extrusion having an outer diameter of 6 inches was cast according to DC casting method from the alloy No. 2 having the composition shown in Table 1. This alloy ingot was heated at 460° C. for 36 hrs. and then taken out from the furnace and allowed to stand for cooling.

Example 5

A round bar ingot for extrusion having an outer diameter of 6 inches was cast according to DC casting method from the alloy No. 2 having the composition shown in Table 1. This alloy ingot was heated at 580° C. for 6 hrs., then cooled down to 420° C. at a cooling velocity of 40° C./hr, and heated at 420° C. for 18 hrs. and taken out from the furnace and allowed to stand for cooling.

Comparative Example 2

A round bar ingot for extrusion having an outer diameter of 6 inches was cast according to DC casting method from the alloy No. 2. The resultant ingot was subjected to a homogenizing treatment at 610° C.×16 hrs. The ingot was transported out of the furnace, cooled with a fan for a short period of time, and then cooled by sprinkling water with the aid of a sprinkler at a cooling velocity of at least 160° C./hr.

The individual ingots obtained in Examples 3~5 and Comparative Example 2 were cut off by a give length to make extrusion billets, which were heated by an induction heater up to 440° C. and hot extruded to form pipe materials of a circle in cross section and having an outer diameter of 18.6 mm, a wall-thickness of 2.3 mm (designated hereinafter like as 18.6 mmϕ×2.3 mm$^t$). The extruded products were air cooled by a fan.

The extrusion was carried out by the aid of a 4 port die capable of obtaining 2 products and forming 4 welding portions in circumferential direction. The 5 extrusion billets were prepared for individual alloys and were continuously extruded.

In case of the third extruded billet portion, the extruded pipe material was used as sample while the fourth extruded billet and the fifth extruded billet were subjected, after extrusion, to 1 pass and 2 pass drawing-elongation processing, respectively, and the 1 pass drawing-elongation processed pipe material and the 2 pass drawing-elongation processed pipe material were collected and offered for various evaluations.

The aforesaid 1 pass drawing-elongation processed pipe material was manufactured by subjecting the pipe material of 18.6 mmϕ×2.3 mm$^t$ to a drawing-elongation processing (working rate: 25.3%) to have 16.0 mmϕ×2.0 mm$^t$, while the aforesaid 2 pass drawing-elongation processed pipe material was manufactured by subjecting the 1 pass drawing-elongation processed pipe material further to a drawing-elongation processing (working rate: 25.0%) to have 13.8 mmϕ×1.75 mm$^t$. The total drawing-elongation working rate of the 2 pass drawing-elongation processed pipe material was 44.0%. A draw-bench was employed for the above drawing-elongation processing.

The extruded pipe material and the drawing-elongation processed pipe materials thus obtained were cut off the portion up to 5 m from the front end, as in Examples 1 and 2, and samples were collected from 3 portions of the remaining front end portion side, the rear end portion side and the intermediate portion.

The sample was measured for electric conductivity in the front end side and in the rear end side according to the four-terminal method and ΔEC was obtained as in Example 1.

Anti-corrosive property of the front end side, the intermediate portion and the rear end side of the sample was investigated according to the 200 hr CASS test. Appearance of the samples after the test was visually observed and evaluated with the same standard as in Example 1.

The results are shown in Table 3.

TABLE 3

| Process for producing pipe materials (Alloy No 2) | Example of the present invention: Example (3) | Example (4) | Example (5) | Comparative example: Comparative example (2) |
|---|---|---|---|---|
| Extruded pipe material 18.6Ø × 2.3 mm | ΔEC = 0.4% A/A/A | ΔEC = 0.6% A/A/A | ΔEC = 0.4% A/A/A | ΔEC = 2.9% C/C/B |
| 1 Pass drawing-elongation pipe material 16.0Ø × 2.0 mm | ΔEC = 0.5% A/A/A | ΔEC = 0.6% A/A/A | ΔEC = 0.7% A/A/A | ΔEC = 2.7% C/C/A |

TABLE 3-continued

| Process for producing pipe materials (Alloy No 2) | Example of the present invention: Example (3) | Example (4) | Example (5) | Comparative example: Comparative example (2) |
|---|---|---|---|---|
| 2 Pass drawing-elongation pipe material 13.8Ø × 1.75 mm | ΔEC = 0.8% A/A/A | ΔEC = 0.6% A/A/A | ΔEC = 0.7% A/A/A | ΔEC = 2.6% C/C/A |

(Remarks)
The bottom phrase in the columns show results of CASS test for Front end portion side/Intermediate portion/Rear end portion side.

As is evident from Table 3, Examples of the present invention (Examples 3, 4 and 5) attained ΔEC of not more than 1.0 IACS % in the extruded pipe material and in both drawing-elongation processed pipe materials. The result of the CASS test was wholly A rank and preferential corrosion in the welding portion was not found at all. No special difference was found between the 1 pass drawing-elongation processed material and the 2 pass drawing-elongation processed material.

Contrary to this, the case of Comparative Example (2) wherein the homogenizing treatment was carried out according to a conventional method attained ΔEC exceeding 1.0 IACS % in the extruded pipe material and in both drawing-elongation processed pipe materials. In the CASS test, serious preferential corrosion in the welding portion was observed in the front end side and the intermediate portion of each extruded billet.

Mechanical properties of the extruded hollow materials manufactured in Examples 1 and 2 and the extruded pipe materials and the drawing-elongation processed pipe materials manufactured in Examples 3~5 were investigated, but all of the materials were provided with given characteristics such as tensile strength and elongation, etc.

Example 6

The alloy A having the composition shown in Table 4 was subjected to DC casting method to cast a round bar ingot of 6 inches in outer diameter for extrusion. The resultant ingot was subjected to the homogenizing treatment shown in Table 5 and electric conductivity of the ingot after the homogenizing treatment was measured. Table 5 shows the results.

Concerning the aforesaid homogenizing treatment, three types of processes were employed, they were a process wherein the ingot was heated at 600° C. for 8 hrs., cooled in the furnace down to 450° C. at a cooling velocity of 50° C./hr, subsequently maintained at 450° C. for 24 hrs. and air cooled to ordinary temperature after maintenance at 450° C. as Example of the present invention; a process wherein the ingot was maintained at 600° C. for 8 hrs., quickly taken out of the furnace and cooled to ordinary temperature by sprinkling water with the aid of a sprinkler (the cooling velocity: >100° C./hr) as Comparative Example 3; and a process wherein the ingot was maintained at 600° C. for 24 hrs., and cooled to ordinary temperature, as in Comparative Example 3, using a sprinkler, as Comparative Example 4.

TABLE 4

| Alloy | Outer diameter of ingot | Si | Fe | Cu | Mn | Mg | Cr | Zn | Ti | Zr | Ni | Al |
|---|---|---|---|---|---|---|---|---|---|---|---|---|
| A | 6 inches ϕ | 0.09 | 0.36 | 0.12 | 1.07 | 0.00 | 0.00 | 0.00 | 0.01 | 0.00 | 0.00 | Balance |
| B | 6 inches ϕ | 0.10 | 0.37 | 0.11 | 1.06 | 0.00 | 0.00 | 0.01 | 0.01 | 0.00 | 0.00 | Balance |
| C | 9 inches ϕ | 0.11 | 0.42 | 0.12 | 1.07 | 0.00 | 0.00 | 0.00 | 0.01 | 0.00 | 0.00 | Balance |
| D | 9 inches ϕ | 0.05 | 0.44 | 0.06 | 0.98 | 0.00 | 0.00 | 0.00 | 0.01 | 0.00 | 0.00 | Balance |
| E | 6 inches ϕ | 0.09 | 0.40 | 0.12 | 1.02 | 0.00 | 0.00 | 0.00 | 0.01 | 0.00 | 0.00 | Balance |
| F | 6 inches ϕ | 0.05 | 0.43 | 0.06 | 0.97 | 0.00 | 0.00 | 0.00 | 0.01 | 0.00 | 0.00 | Balance |
| G | 6 inches ϕ | 0.09 | 0.37 | 0.11 | 1.08 | 0.01 | 0.00 | 0.01 | 0.01 | 0.00 | 0.00 | Balance |
| H | 6 inches ϕ | 0.09 | 0.39 | 0.12 | 0.80 | 0.00 | 0.00 | 0.00 | 0.01 | 0.00 | 0.00 | Balance |
| I | 6 inches ϕ | 0.11 | 0.40 | 0.12 | 1.03 | 0.30 | 0.00 | 0.00 | 0.01 | 0.00 | 0.00 | Balance |
| J | 6 inches ϕ | 0.45 | 0.15 | 0.45 | 1.11 | 0.00 | 0.00 | 0.00 | 0.01 | 0.00 | 0.00 | Balance |
| K | 6 inches ϕ | 0.17 | 0.32 | 0.13 | 1.05 | 0.00 | 0.00 | 0.20 | 0.01 | 0.00 | 0.00 | Balance |
| L | 6 inches ϕ | 0.10 | 0.38 | 0.11 | 0.51 | 0.00 | 0.00 | 0.00 | 0.01 | 0.00 | 0.00 | Balance |
| M | 6 inches ϕ | 0.09 | 0.38 | 0.12 | 1.33 | 0.00 | 0.00 | 0.00 | 0.01 | 0.00 | 0.00 | Balance |
| N | 6 inches ϕ | 0.11 | 0.37 | 0.13 | 1.55 | 0.00 | 0.00 | 0.00 | 0.01 | 0.00 | 0.00 | Balance |
| O | 6 inches ϕ | 0.10 | 0.34 | 0.14 | 1.09 | 0.48 | 0.00 | 0.00 | 0.01 | 0.00 | 0.00 | Balance |
| P | 6 inches ϕ | 0.28 | 0.30 | 0.55 | 1.08 | 0.00 | 0.00 | 0.00 | 0.01 | 0.00 | 0.00 | Balance |

TABLE 5

| Item | Conditions of homogenizing treatment | Electric conductivity after homogenizing treatment | Extruded material (N ordinal number) | Result of measurement of electic conductivity: Front end portion side (No. 1) | Inter-mediate portion (No. 4) | Rear end portion side (No. 7) | Difference in electic conductivity between the front end and rear end ΔEC |
|---|---|---|---|---|---|---|---|
| Example of the present invention | 600° C. × 8 hr + 450° C. × 24 hr air cooling (600° C. → 450° C.: Cooling velocity 50° C./hr) | 39.3 % IACS | 3rd | 40.7 | 40.7 | 41.2 | 0.5 |
| | | | 5th | 40.8 | 40.8 | 41.4 | 0.6 |
| Comparative example 3 | Holding at 600° C. × 8 hrs. followed by cooling with sprinkling water with the aid of a sprinkler | 36.6 % IACS | 3rd | 39.1 | 39.4 | 40.3 | 1.2 |
| | | | 5th | 39.1 | 39.4 | 40.2 | 1.1 |
| Comparative example 4 | Holding at 600° C. × 24 hrs. followed by cooling with sprinkling water with the aid of a sprinkler | 37.7 % IACS | 3rd | 40.1 | 40.3 | 41.4 | 1.3 |
| | | | 5th | 39.7 | 40.3 | 40.9 | 1.2 |

As is evident from Table 5, the ingot treated according to Example of the present invention was higher in electric conductivity than the ingot treated according to Comparative Examples 3 and 4, showing proceeding of the precipitation of the Mn-containing compound. As compared with the electric conductivity before the homogenizing treatment (36.5 IACS %), the precipitation scarcely proceeded in Comparative Examples 3 and 4 from the state of the ingot.

The ingots cut off by a given length were subjected to the homogenizing treatment under the respective conditions, and each 5 ingots were continuously hot extruded respectively to pipe materials of 8 mmϕ×1.0 mm$^t$, using a port hole die having 4 ports. In the extruded pipe materials, 4 welding portions in circumferential direction existed continuously in the lengthwise direction. The billets were heated at 420~460° C. by an induction heater. The extruding velocity of the pipe material was 60 m/min. The pipe material just after extrusion was cooled with water, and attached water droplets were removed by blowing and further the pipe material was wound by way of an in-line coiler.

The extruded materials in the form of a coil were cut off by a definite length of 6 m and stretched (straightened out). Sampling was made from a given position of the pipe material.

With respect to the 3rd. and 5th continuous extrusion billets, sampling was made from 7 positions from the front end side of the extrusion to the rear end side by every 30 m, and electric conductivity, mechanical performance, and anti-corrosive property thereof were investigated. The electric conductivity was measured according to the 4 terminals method.

With respect to the portions of the 2nd and 4th continuous extrusion billets, workability was investigated in consideration of the application to piping of air conditioners, etc. The results are shown together in Table 5.

As is evident from Table 5, the electric conductivity tends to increase in all of the cases of after extrusion rather than after the homogenizing treatment, and the front end side of the extrusion rather than the rear end side of the extrusion.

In order to compare the electric conductivity in the lengthwise direction of the extruded pipe materials, differences (designated as ΔEC) between the front end side and the rear end side of the extruded pipe materials are also shown in Table 5. ΔEC exceeded 1% in either of Comparative Examples 3 and 4, while that kept 0.5~0.6% in Example of the present invention.

This fact shows that a phenomenon of proceeding the precipitation during the extrusion and increasing the precipitating amount in the latter half is inhibited by the homogenizing treatment in the present invention.

Next, tensile characteristics were observed.

The tensile strength (TS), 0.2% yielding strength (YS), and elongation (El) of samples in the central portion in the lengthwise direction of the extruded pipe materials were measured. Table 6 shows the results.

TABLE 6

| Item | Extruded material (N ordinal number) | Tensile characteristics TS ($N/mm^2$) | YS ($N/mm^2$) | El (%) |
|---|---|---|---|---|
| Example of the present invention | 3rd | 99 | 65 | 35 |
| (600° C. × 8 hr + | 5th | 100 | 66 | 37 |
| 450° C. × 24 hr air cooling) | | | | |
| Comparative example 3 | 3rd | 103 | 70 | 34 |
| (600° C. × 8 hr water cooling) | 5th | 101 | 69 | 35 |
| Comparative example 4 | 3rd | 100 | 67 | 35 |
| (600° C. × 24 hr water cooling) | 5th | 101 | 66 | 36 |
| <Referential example> The current material Standard for (extrusion→drawing-elongation→annealing) | | 95~125 | >35 | >30 |

As is evident from Table 6, no difference in tensile characteristics is found between Example of the present invention and Comparative Examples, both satisfying the tensile characteristics required for the current pipe materials. Accordingly, the pipe material of the present invention is furnished with the characteristics and workability desired in the current pipe materials.

Next, attention was paid to corrosion in the welding portion which was a matter of concern in port hole extruded pipe materials, and anti-corrosive property in the portion was investigated.

A corrosion test was carried out for all materials for 240 hrs. according to CASS testing method defined in JIS-H-8681. As external corrosion was taken up as a problem in consideration of pipes for air conditioners of automobiles, attention was made by closing the terminal ends of the test pipe material, lest any internal corrosion should take place inside the pipe.

A result of washing the samples after the corrosion test followed by visual observation of the samples showed that all of non-welding portions (portions other than welding portions) underwent pitting corrosion shortly before penetration, and no particular difference in level were found between Examples of the present invention and Comparative Examples. The state of this pitting corrosion was almost same level as in the current pipe materials (3003 alloy manufactured by the steps of extrusion, drawing-elongation, and annealing) separately tested. Preferential corrosion of the welding portion was evaluated by classifying the degree into 5 grades.

Table 7 shows the results.

TABLE 7

| Item | Extruded material (N ordinal number) | Sampling position in lengthwise direction of the extruded material: No. 1 (front end portion) | No. 2 | No. 3 | No. 4 | No. 5 | No. 6 | No. 7 (rear end portion) |
|---|---|---|---|---|---|---|---|---|
| The example of the present invention | 3rd | ▲ | ○ | ◎ | ◎ | ◎ | ◎ | ◎ |
| | 5th | ▲ | ○ | ○ | ◎ | ◎ | ◎ | ◎ |
| Comparative example 3 | 3rd | X | ▲ | ▲ | ▲ | ▲ | Δ | Δ |
| | 5th | X | X | X | ▲ | ▲ | Δ | ◎ |
| Comparative example 4 | 3rd | ▲ | ▲ | ▲ | Δ | ○ | ○ | ◎ |
| | 5th | ▲ | Δ | ▲ | Δ | ○ | ○ | ◎ |

CASS test: 240 hr
<Evaluation of preferential corrosion of the welding portion>
◎ No corrosion
○ Slight shallow corrosion (shallower than the depth of pitting corrosion)
Δ Corrosion existed not more than 10% of full length
▲ Corrosion existed 10 to 50% of full length
X Corrosion existed 50% or more of full length As is evident from Table 7, preferential corrosion of the welding portion is significant at the front end portion side in all materials, and is scarcely takes place at the rear end portion side. Between Example of the present invention and Comparative Examples, however, the degree of generation of preferential corrosion is seriously different. Namely, preferential corrosion is generated in many test samples in Comparative Examples, while such corrosion is limited to a part of the front end side of the extrusion in Example of the present invention.

In the materials marked with ▲ or X, a penetration hole is formed in the majority of the cases in the portion where preferential corrosion is generated. In this respect, the pipe materials of Comparative Examples are not desirable since there is a fear of premature leakage caused by corrosion when applied to pipes for air conditioners of automobiles. On the other hand, the pipe materials of Example of the present invention fully withstand the use except only a part of the front end side.

Next, bending workability and terminal processing workability necessary for pipes for air conditioners of automobiles were investigated.

The bending workability was tested using an NC bending processing machine with bending angles of 2 standards of 45° and 90° and with a bending R of 25 mm.

As samples, 3 samples of 30 cm in length were picked up among the 7 portions at the same interval in the lengthwise direction of each section of the 2nd and 4th billets of the extruded pipe material of Example of the present invention and the extruded pipe materials of Comparative Examples 3 and 4. Table 8 shows the results.

TABLE 8

| Item | Extruded material (N ordinal number) | Bending angle | Sampling position in lengthwise direction of the extruded material: No. 1 (front end portion) | No. 2 | No. 3 | No. 4 | No. 5 | No. 6 | No. 7 (rear end portion) |
|---|---|---|---|---|---|---|---|---|---|
| Example of the present invention | 2nd | 45° | ○ | ○ | ○ | ○ | ○ | ○ | ○ |
| | | 90° | ○ | ○ | ○ | ○ | ○ | ○ | ○ |
| | 4th | 45° | ○ | ○ | ○ | ○ | ○ | ○ | ○ |
| | | 90° | ○ | ○ | ○ | ○ | ○ | ○ | ○ |
| Comparative example 3 | 2nd | 45° | ○ | ○ | ○ | ○ | ○ | ○ | ○ |
| | | 90° | ○ | ○ | ○ | ○ | ○ | ○ | ○ |
| | 4th | 45° | ○ | ○ | ○ | ○ | ○ | ○ | ○ |
| | | 90° | ○ | ○ | ○ | ○ | ○ | ○ | ○ |
| Comparative example 4 | 2nd | 45° | ○ | ○ | ○ | ○ | ○ | ○ | ○ |
| | | 90° | ○ | ○ | ○ | ○ | ○ | ○ | ○ |
| | 4th | 45° | ○ | ○ | ○ | ○ | ○ | ○ | ○ |
| | | 90° | ○ | ○ | ○ | ○ | ○ | ○ | ○ |

○: No abnormality
X: Abnormality exists

As is evident from Table 8, all of the samples of Example of the present invention and Comparative Examples 3 and 4 were stably subjected to bending processing without causing crack, collapse, surface roughening, etc.

Thus, the annealed pipe material of alloy 3003 of a conventional type and the pipe material of the present invention are of the same characteristics. This is due to the fact that the pipe material of the present invention exceeds an elongation value of 30% and is homogeneous and fine in crystalline structure.

Next, the terminal processing workability will be stated.

Figure 2:
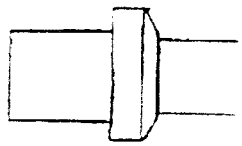
FIG. 2(A), FIG. 2(B), FIG. 2(C), and FIG. 2(D) are explanatory drawings of the types A, B, C, and D of the terminal end processing for extruded pipe materials for air conditioner piping, respectively.
Figure 2:
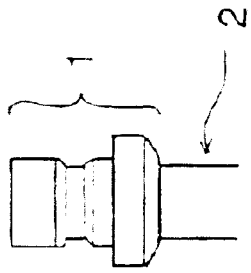
Figure 2:
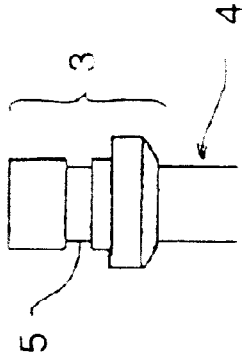
Figure 2:
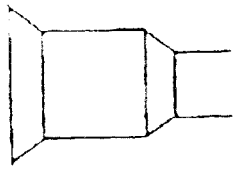
Figure 3:
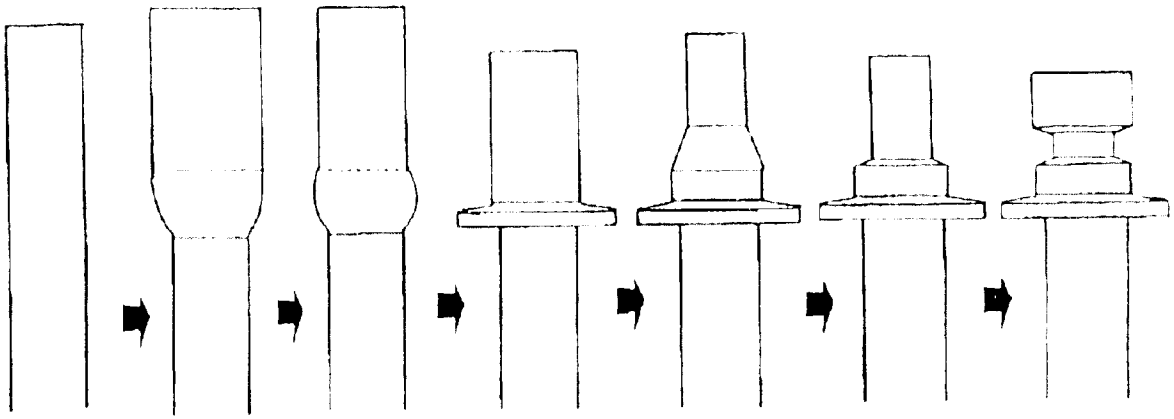
FIG. 3(A) and FIG. 3(B) are flow sheets of the terminal end processing of the type B shown in FIG. 2(B) and the type C shown in FIG. 2(C), respectively.
Figure 3:
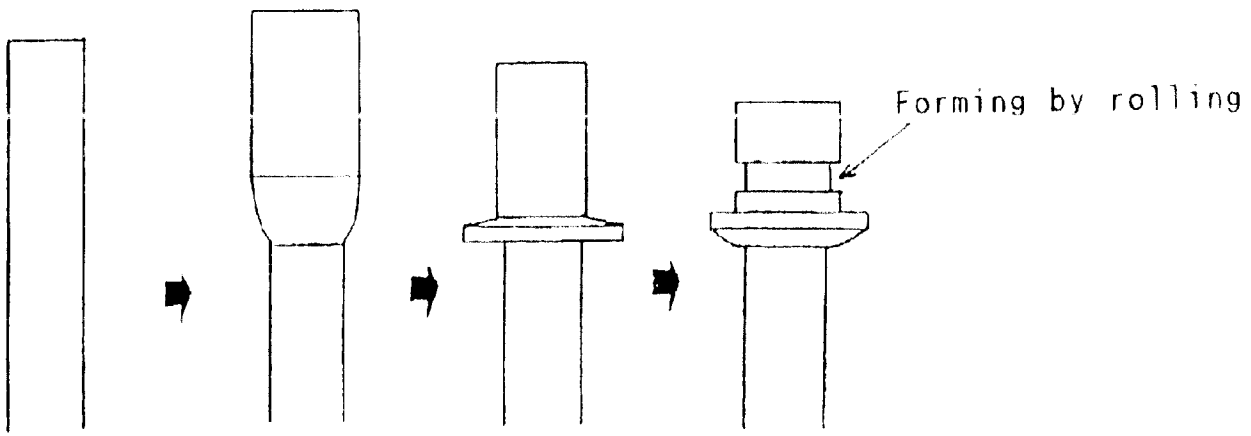

The terminal processing of Type B shown in FIG. 2(B) and Type C shown in FIG. 2(C) is called the shaft seal bead, which is a new type of bead processing adopted significantly in recent years. Both types are different in processing method. Namely, the Type B makes processing by way of punch shaping (a combination of pipe expanding and pipe condensing) over the all processing steps as shown in FIG. 3(A), while the Type C makes the processing by way of punch shaping on the way but finally makes the processing by way of forming by rolling to form a groove portion as shown in FIG. 3(B).

Table 9 shows the result of a terminal processing test wherein 3 samples having a length of 20 cm were picked up and tested respectively from 3 portions at the same interval in lengthwise direction of the 2nd and 4th billets of the extruded pipe material of Example of the present invention. The terminal processing workability is shown by the presence or absence of abnormality in the samples after the test.

TABLE 9

| Extruded material tested | Shape of terminal processing (cf. FIG. 2(A)~FIG. 2(D)) | Sampling position in lengthwise direction of the extruded material: No. 1 (front end portion) | No. 4 | No. 7 (rear end portion) |
|---|---|---|---|---|
| Example of the present | Type A | ○ | ○ | ○ |
| | Type B | ○ | ○ | ○ |

TABLE 9-continued

| Extruded material tested | Shape of terminal processing (cf. FIG. 2(A)~FIG. 2(D)) | Sampling position in lengthwise direction of the extruded material: No. 1 (front end portion) | No. 4 | No. 7 (rear end portion) |
|---|---|---|---|---|
| invention (2nd extruded material) | Type C | ○ | ○ | ○ |
| | Type D | ○ | ○ | ○ |
| Example of the present invention (4th extruded material) | Type A | ○ | ○ | ○ |
| | Type B | ○ | ○ | ○ |
| | Type C | ○ | ○ | ○ |
| | Type D | ○ | ○ | ○ |

○: No abnormality
X: Abnormality exists

From Table 9, it is understood that the pipe material of Example of the present invention can be processed soundly in any type of the terminal processing A~D, without raising any special problem in dimensions and appearance in any position (the front end portion—the intermediate portion-the rear end portion) in lengthwise direction of the extruded material.

As the dimensional accuracy of the terminal processing portion is greatly influenced by dispersion of the extruded material, dispersion in outer diameter and wall-thickness of the extruded pipe material was investigated using the pipe material of Example of the present invention.

As the result, the dimension of the extruded pipe material was the maximum 8.05 mm and the minimum 7.92 mm in outer diameter and the maximum 1.04 mm and the minimum 0.97 mm in wall-thickness, showing almost same dimensional dispersion as in the current pipe materials. With a pipe material dimension of this level, the extruded pipe material of the present invention can fully satisfactorily be used as pipes for air conditioners of automobiles.

Next, the surface state of the processed terminal end of the Type B (shown by 1 in FIG. 2(B), while the pipe portion not yet processed is shown by 2) was observed by the aid of a scanning electron microscope (SEM) and compared with that of the current pipe materials.

Figure 4:
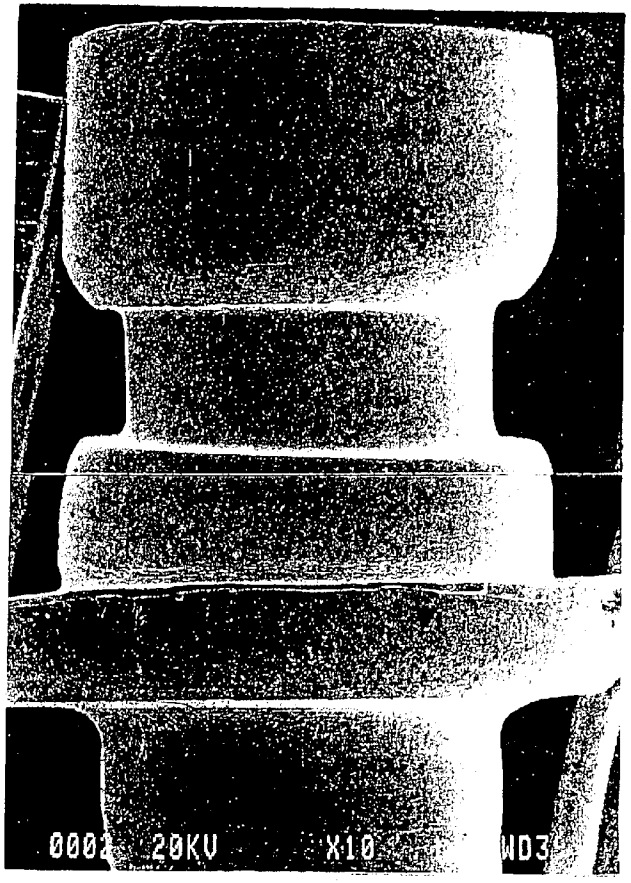
FIG. 4(A) and FIG. 4(B) are SEM photographs showing the terminal end processing of the type B for a currently used pipe material and for an example of pipe material of the present invention, respectively.
Figure 4:
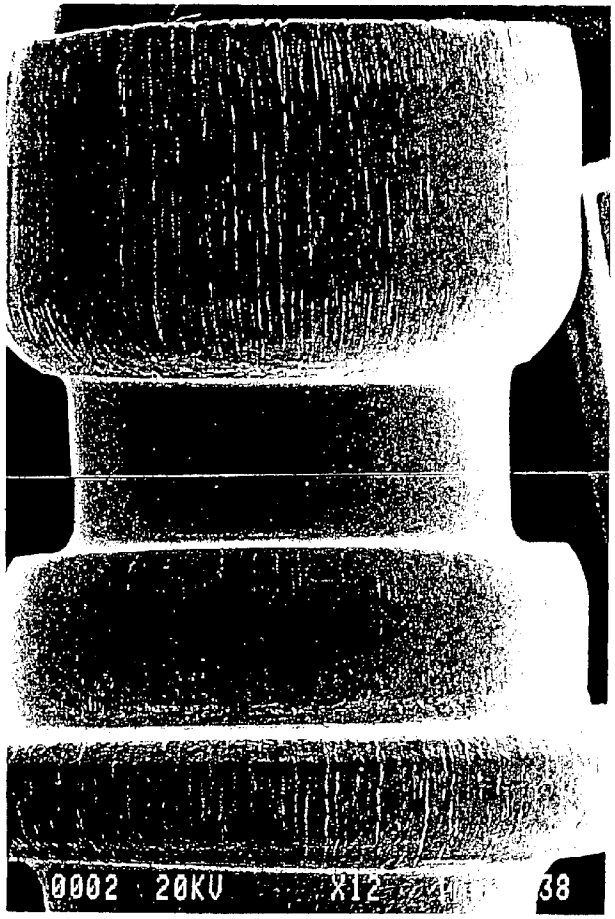

As shown in the photograph of FIG. 4(A), a great number of remarkable striae pattern in lengthwise direction was unavoidably present in the processed terminal end portion (1) of the current pipe material, owing to minute streaks (defect in the form of groove) formed on the surface of the pipe material at the time of drawing-elongation processing. Contrary to this, such fine striation was not observed, as shown in the photograph in FIG. 4(B), in the processed terminal end portion (1) of the pipe material of Example of the present invention, and the material presented extremely smooth surface state.

Next, the surface state of the processed terminal end of the Type C (shown by 3 in FIG. 2(C), while the pipe portion not processed is shown by 4) was observed and compared with that of the current pipe materials. In the processed terminal end portion (3) of the current pipe material, a great number of exfoliated pieces of the aluminum base material were generated in a groove portion (5) formed by rolling. It is presumed that this rolling spalling is influenced by defect of striation or fine striation at the time of the drawing-elongation processing.

Contrary to this, the processed terminal end portion (3) of the pipe material of Example of the present invention showed a beautiful processed surface utterly free of any rolling spalling.

As described above, a similar result was obtained in the case of extruding at a high speed as high as 100 m/min in addition to the pipe material extruded at an extrusion velocity of 60 m/min.

In view of the foregoing, the extruded pipe material of the present invention is furnished with strength performance, anti-corrosive property, bending/terminal end processing workability, extrusion workability, etc., which have to be required for pipes of air conditioners for automobiles, and is a suitable material for pipes of air conditioners for automobiles.

Concerning mechanical properties and workability, no problem arises in the conventional port hole extruded pipe materials. However, a problem arises in anti-corrosive property causing preferential corrosion in welding portions. On the other hand, the port hole extruded pipe materials of the present invention to which a given homogenizing treatment has been applied are free of defect such as preferential corrosion.

The pipe material of the present invention lacking necessity for drawing-elongation processing and annealing enables simplification of steps and reduction in production cost. Further, the pipe material is good in the surface quality and is suited for pipe materials for air conditioners of automobiles.

Example 7

The alloy B having a composition as shown in Table 4 was subjected to DC casting method to cast a round bar ingot for extrusion having the outer diameter of 6 inches, which was subjected to a homogenizing treatment wherein the ingot was maintained at 600° C. for 4 hrs., cooled down to 450° C. in the furnace at a cooling velocity of 50° C./hr, successively maintained at 450° C. for 24 hrs. and thereafter air cooled down to room temperature.

The ingot was cut off to have a given length, heated at 440~460° C. by induction heating, and each 5 ingots were continuously extruded by using a port hole die having 4 ports or 3 ports respectively to form pipe materials having a smaller diameter of 8 mmϕ×1 mm$^t$ and pipe materials having a large diameter of 12.7 mmϕ×1.2 mm$^t$ at an extrusion velocity of 40 m/min.

The extruded material was air cooled with a fan just after extrusion, and cut off as such to effect stretching.

The resultant round bar ingot and extruded pipe materials were investigated, as in Example 6, for various performance such as electric conductivity of the ingot, electric conductivity of the pipe materials after extrusion, a difference in electric conductivity between the front end and the rear end of the pipe materials after extrusion, tensile characteristics, anti-corrosive property, preferential corrosion property in the welded portion and workability. As the results, the same results as in Example 6 were obtained.

Example 8

Round bar ingots for extrusion having an outer diameter of 9 inches were cast according to DC casting method from the alloys C and D having the compositions shown in Table 4. Further, round bar ingots for extrusion having an outer diameter of 6 inches were cast according to DC casting method from alloys E and F. The ingots were subjected to a homogenizing treatment wherein the ingots were maintained at 600° C. for 4 hrs. cooled in the furnace down to 450° C. at a cooling velocity of 50° C./hr, and successively maintained at 450° C. for 10 hrs. and air cooled to ordinary temperature after maintaining at 450° C.

After the homogenizing treatment, the ingots were cut off to have a given length to form extrusion billets and each 5 billets were extruded continuously according to the port hole extrusion method.

The billets of 9 inches were extruded to pipe materials having a larger diameter of 16 mmϕ×1.2 mm$^t$ and pipe materials having a smaller diameter of 8 mmϕ×1 mm$^t$. This extrusion was carried out by simultaneous extrusion of 4 products where 3 welding portions existed.

The billets of 6 inches were extruded to pipe materials having a larger diameter of 12.7 mmϕ×1.2 mm$^t$ and pipe materials having 8 mmϕ×1 mm$^t$ which are different in size from the billets of 9 inches. This extrusion was carried out by simultaneous extrusion of 2 products with 3 welding portions.

Heating of the billets on extrusion was carried out by using a gas burner type re-heating furnace in the case of the 9 inch materials and by an induction heating in the case of the 6 inch materials. The heating temperature for the billets was 440~480° C. The extrusion velocity was 25 m/min. in the case of the 9 inch products to be a pipe of 8 mm in an outer diameter, while the other cases were 40 m/min. The materials just after extrusion were cooled with a fan, cut off as straight materials without coiling, and stretched.

The resultant round bar ingot and extruded pipe materials were investigated for various performance necessary for pipes of air conditioners for automobiles, such as electric conductivity of the ingots, electric conductivity of the extruded pipe materials, a difference in electric conductivity between the front end and the rear end of the pipe materials, tensile characteristics, anti-corrosive property, preferential corrosion property in the welding portion and terminal end workability.

Further, pipe materials were manufactured as trial by modifying the conditions alone of the homogenizing treatment and likewise made various investigations. As the modification points of the homogenizing treatment, one was the modification of the cooling velocity to 25° C./hr down to 450° C. after maintenance at 600° C. and the other was the modification of the holding time at 450° C. to 4 hrs. or 16 hrs.

As the result, the same results as in Example 6 were obtained.

Example 9

That the pipe materials of this invention possess a satisfactory anti-corrosive property against preferential corrosion in the welding portion, which is taken up as the most serious problem in application of the materials as pipes for air conditioners of automobiles will be explained.

Round bar ingots for extrusion having an outer diameter of 6 inches were cast according to DC casting method from the alloy G having the composition as shown in Table 4. After the homogenizing treatment the ingot was measured for electric conductivity. Table 10 shows the results.

The homogenizing treatment for Examples 1–4 of the present invention was carried out by initially maintaining the ingots at a relatively high temperature, cooling the ingots in the furnace down to 450~420° C. at which the Mn-containing compounds were most precipitated, and after being held at the same temperature, air cooling the ingots to ordinary temperature.

In Examples 5–9 of the present invention, the ingots were maintained at a relatively high temperature, cooled in the furnace down to 350° C. at a cooling velocity of 30° C./hr, and cooled in the furnace or in the air from 350° C.

In Example 10 of the present invention, the treatment was carried out to contemplate that the ingot was held at the initial stage at 450° C. at which the precipitation proceeded easily for 2 hrs. to precipitate fine precipitates, and then the temperature was elevated up to 600° C. while the ingot was held for a short period of time, and thereafter the ingot was cooled in the furnace at 30° C./hr whereby the precipitates became greater in diameter.

Example 11 of the present invention contemplated to promote the precipitation by maintaining the ingot at around 450° C. at which the precipitation proceeded easily for a comparatively long period of time.

Among Comparative Examples in Table 10, Comparative Example 5 and 6 were carried out under the same or almost same conditions as in the homogenizing treatment frequently used for Al—Mn series alloys by maintaining the ingot at a high temperature, and Comparative Examples 7 was carried out at 560° C. for 3 hrs., and thereafter materials were cooled at a high cooling velocity (>100° C./hr) by sprinkling water or by air cooling.

TABLE 10

| Item | Material | Conditions of homogenizing treatment | Electric conductivity after homogenizing treatment (IACS %) |
|---|---|---|---|
| Example of the present invention | 1 | 610° C. × 4 hr + 450° C. × 20 hr air cooling (610° C. → 450° C.: 30° C./hr) | 41.1 |
| | 2 | 580° C. × 4 hr + 450° C. × 20 hr air cooling (580° C. → 450° C.: 30° C./hr) | 41.3 |
| | 3 | 610° C. × 4 hr + 420° C. × 20 hr air cooling (610° C. → 450° C.:30° C./hr) | 41.4 |
| | 4 | 525° C. × 2 hr + 450° C. × 12 hr air cooling (525° C. → 450° C.: 30° C./hr) | 43.7 |
| | 5 | 550° C. × 12 hr cooling in furnace (550° C. → RT: 30° C./hr) | 42.0 |
| | 6 | 550° C. × 12 hr cooling in furnace (550° C. → 350° C.: 30° C./hr, below 350° C. air cooling) | 41.9 |
| | 7 | 550° C. × 6 hr cooling in furnace (550° C. → 350° C.: 30° C./hr, below 350° C. air cooling) | 41.7 |
| | 8 | 525° C. × 8 hr cooling in furnace (525° C. → 350° C.: 30° C./hr, below 350° C. air cooling) | 42.5 |
| | 9 | 600° C. × 4 hr cooling in furnace (600° C. → 350° C.: 30° C./hr, below 350° C. air cooling) | 41.0 |
| | 10 | 450° C. × 2 hr + 600° C. × 2 hr cooling in furnace (450° C. → 600° C.: 50° C./hr, 600° C. → RT: 30° C./hr) | 41.1 |
| | 11 | 450° C. × 36 hr air cooling | 46.2 |
| Comparative Example | 5 | 610° C. × 6 hr cooling by sprinkling water (cooling by sprinkling water: ingot was taken out of furnace and water cooled with the aid of a sprinkler) | 36.8 |
| | 6 | 600° C. × 12 hr air cooling | 37.6 |
| | 7 | 560° C. × 3 hr cooling by sprinkling water (cooling by sprinkling water: ingot was taken out of furnace and water cooled with the aid of a sprinkler) | 38.9 |

The individual extrusion billets were cut off after the homogenizing treatment, and the individual cut pieces of 3 were hot extruded to pipe materials of 12.7 mmϕ×1.2 mm$^t$ by the aid of a port hole die. In all ingots, the billets were heated by way of induction heating within the range of 430–470° C. and extruded. In all of the cases, 3rd product was evaluated for investigation of the characteristics of the extruded pipe materials. The samples for evaluation were picked up from 6 positions at the same interval over the full length of the extruded pipe materials. The collected samples were measured for electric conductivity. Table 11 shows the results.

In Table 11 was shown a result of measurement in the front end portion side (No.1) where the lowest electric conductivity was shown and the rear end portion side (No. 6) where the highest electric conductivity was shown, and a difference (ΔEC) between both.

From Table 11, Examples of the present invention were involved in the electric conductivity of around 41~43 IACS %, and the difference in electric conductivity ΔEC between the front and the rear ends was not more than 1 IACS % in all of the cases. This is due to the fact that the precipitation already proceeds at the stage of the homogenizing treatment and the precipitation at the extrusion stage is inhibited.

On the other hand, Comparative Examples showed the tendency of increasing in electric conductivity from the front end side to the rear end side because of precipitation during the extrusion, and showed ΔEC of 1.6 IACS % to nearly 2 IACS %.

Next, anti-corrosive property was investigated by CASS test (testing time: 200 hrs.) and a result thereof is shown in Table 12.

In this case, preferential corrosion in the welding portion was observed and the degree of corrosion was evaluated.

TABLE 11

| Item | Material | Conditions of homogenizing treatment | Result of measurement of electric conductivity | | |
|---|---|---|---|---|---|
| | | | Front end portion side (No. 1) | Rear end portion side (No. 6) | Difference in EC between the front end and the rear end (ΔEC) |
| Example of the present invention | 1 | 610° C. × 4 hr + 450° C. × 20 hr air cooling (610° C. → 450° C.: 30° C./hr) | 42.0 | 42.6 | 0.6 |
| | 2 | 580° C. × 4 hr + 450° C. × 20 hr air cooling (580° C. → 450° C.: 30° C./hr) | 42.2 | 42.7 | 0.5 |
| | 3 | 610° C. × 4 hr + 420° C. × 20 hr air cooling (610° C. → 450° C.: 30° C./hr) | 42.2 | 42.5 | 0.3 |
| | 4 | 525° C. × 2 hr + 450° C. × 12 hr air cooling (525° C. → 450° C.: 30° C./hr) | 41.0 | 41.0 | 0.0 |
| | 5 | 550° C. × 12 hr cooling in furnace (→ RT: 30° C./hr) | 42.2 | 43.1 | 0.9 |
| | 6 | 550° C. × 12 hr cooling in furnace (→ 350° C.: 30° C./hr, below 350° C. air cooling) | 42.1 | 42.9 | 0.8 |
| | 7 | 550° C. × 6 hr cooling in furnace (→ 350° C.: 30° C./hr, below 350° C. air cooling) | 41.6 | 42.5 | 0.9 |
| | 8 | 525° C. × 8 hr cooling in furnace (→ 350° C.: 30° C./hr, below 350° C. air cooling) | 41.3 | 42.3 | 1.0 |
| | 9 | 600° C. × 4 hr cooling in furnace (600° C. → 350° C.: 30° C./hr. below 350° C. air cooling) | 41.8 | 42.5 | 0.7 |
| | 10 | 450° C. × 2 hr + 600° C. × 2 hr cooling in furnace (→ 600° C.: 50° C./hr, 600° C. → RT: 30° C./hr) | 41.7 | 42.4 | 0.7 |
| | 11 | 450° C. × 36 hr air cooling | 42.0 | 42.6 | 0.6 |
| Comparative Example | 5 | 610° C. × 6 hr cooling by sprinkling water | 38.6 | 40.2 | 1.6 |
| | 6 | 600° C. × 12 hr air cooling | 38.9 | 40.8 | 1.9 |
| | 7 | 560° C. × 3 hr cooling by sprinkling water | 39.0 | 40.8 | 1.8 |

TABLE 12

| Item | Material | Conditions of homogenizing treatment | Sampling position in lengthwise direction of the direction of the extruded material: No. 1 (Front end portion side) | No. 2 | No. 3 | No. 4 | No. 5 | No. 6 (Rear end portion side) |
|---|---|---|---|---|---|---|---|---|
| Example of the present invention | 1 | 610° C. × 4 hr + 450° C. × 20 hr air cooling | ◎ | ◎ | ◎ | ◎ | ◎ | ◎ |
| | 2 | 580° C. × 4 hr + 450° C. × 20 hr air cooling | ◎ | ◎ | ◎ | ◎ | ◎ | ◎ |
| | 3 | 610° C. × 4 hr + 420° C. × 20 hr air cooling | ◎ | ◎ | ◎ | ◎ | ◎ | ◎ |
| | 4 | 525° C. × 2 hr + 450° C. × 12 hr air cooling | ◎ | ◎ | ◎ | ◎ | ◎ | ◎ |
| | 5 | 550° C. × 12 hr cooling in furnace | ◎ | ◎ | ◎ | ◎ | ◎ | ◎ |
| | 6 | 550° C. × 12 hr cooling in furnace | ◎ | ◎ | ◎ | ◎ | ◎ | ◎ |
| | 7 | 550° C. × 6 hr cooling in furnace | ◎ | ◎ | ◎ | ◎ | ◎ | ◎ |
| | 8 | 525° C. × 8 hr cooling in furnace | ◎ | ◎ | ◎ | ◎ | ◎ | ◎ |
| | 9 | 600° C. × 4 hr cooling in furnace | ○ | ◎ | ◎ | ◎ | ◎ | ◎ |
| | 10 | 450° C. × 2 hr + 600° C. × 2 hr cooling in furnace | ○ | ◎ | ◎ | ◎ | ◎ | ◎ |
| | 11 | 450° C. × 36 hr air cooling | ◎ | ◎ | ◎ | ◎ | ◎ | ◎ |
| Comparative Example | 5 | 610° C. × 6 hr cooling by sprinkling water | X | X | ▲ | ▲ | Δ | Δ |
| | 6 | 600° C. × 12 hr air cooling | X | ▲ | ▲ | Δ | Δ | ○ |
| | 7 | 560° C. × 3 hr cooling by sprinkling water | ▲ | Δ | Δ | Δ | ◎ | ◎ |

Notice : Evaluation of preferential corrosion of the welding portion was similar to Example 6.

In all of the materials, no abnormality in the state of pitting corrosion existed in the welding portion.

Examples of the present invention showed extremely excellent anti-corrosive property wherein the corrosion condition in the welding portion was ◎ (no corrosion in the welding portion) or ○ (existence of a slight number of shallow pitting corrosion). ○ shows a tendency of corrosion in the welding portion, but proceeding of the corrosion is slower than non-welding portion, raising no problem in practical use.

On the other hand, all Comparative Examples showed a remarkable preferential corrosion in the welding portion, especially the position of ▲ and x formed a penetration hole.

As this result, it is understood that anti-corrosive property at welding portion can be secured as in the present invention by properly regulating the conditions for the homogenizing treatment to suppressing a difference in electric conductivity (difference in the state of precipitation) in lengthwise direction of the extruded pipe materials caused by the precipitation at the time of extrusion to not more than 1 IACS %.

As a result of investigating the mechanical performance, 11 kinds of the pipe materials shown in Examples of the present invention as well as 3 kinds of the pipe materials shown in Comparative Examples were all exhibited a tensile strength of 99~108 N/mm$^2$, a 0.2% yielding strength of 38~45 N/mm$^2$, and an elongation within the range of 38~43%, showing the same tensile characteristics as the current materials.

It is further confirmed that the bending workability and shaft seal bead processing (B type as shown in FIG. 2(B)) were all excellent in the pipe materials of example of the present invention.

Example 10

Round bar ingots for extrusion having an outer diameter of 6 inches were cast according to DC casting method from alloys H~P having the composition as shown in Table 4. The resultant ingots were subjected to the same homogenizing treatment as in Example 8 (600° C.×4 hr+450° C.×10 hr air cooling: a cooling velocity of 50° C./hr for 600° C.→450° C.), and thereafter the ingots were cut off to form extrusion billets which were subjected to a port hole extrusion method capable of extruding simultaneously 2 products thereby extruding pipe materials of 12.7 mmϕ×1.2 mm$^t$ (3 positions of the welding portion).

The billets on extrusion were heated at a heating temperature of 440~480° C. by way of induction heating. Although an extrusion velocity aimed at was 50 m/min, extrusion at such velocity was impossible according to the quality of the materials.

TABLE 13

| Alloy | Remarks | Possibility or impossibility of extrusion | Electric conductivity of the extruded material: Front end portion side (No. 1) | Rear end portion side (No. 6) | Difference in EC between the front end and the rear end (ΔEC) |
|---|---|---|---|---|---|
| H | Example of the present invention | Extrusion possible | 44.1 | 44.5 | 0.4 |
| I | Example of the present invention | Extrusion possible | 39.3 | 39.1 | −0.2 |
| J | Example of the present invention | Extrusion possible | 46.7 | 46.4 | −0.3 |
| K | Example of the present invention | Extrusion possible | 43.4 | 43.8 | 0.4 |
| L | Comparative Example | Extrusion possible | 41.8 | 42.3 | 0.5 |
| M | Example of the present invention | Extrusion possible | 43.1 | 43.6 | 0.5 |
| N | Comparative Example | No increase in extrusion velocity | — | — | — |
| O | Comparative Example | Extrusion impossible | — | — | — |
| P | Comparative Example | No increase in extrusion velocity | — | — | — |

As is evident from Table 13, the alloys H~M could be extruded at a given extrusion velocity, but the alloys N and P were very slow in extrusion velocity as well as 5 m/min and became impossible to extrude at the final stage of extrusion. Further, the alloy O was utterly impossible to extrude. This is due to the fact that the alloys N and P were incorporated respectively with Mn and Cu excessively, therefore they were high in the hot deformation resistance, while the alloy O was incorporated excessively with Mg, which is most responsible of raising deformation resistance.

Accordingly, these alloys are not suited for extrusion of relatively thin pipes of a smaller diameter utilizable as pipes for air conditioners of automobiles.

Next, with respect to the extruded pipe materials capable of being extruded, individual portions in lengthwise direction of the extruded pipe materials were measured for electric conductivity. Table 13 shows the values of the front end portion side (No.1), the rear end portion side (No. 6) and ΔEC, but ΔEC, a difference in electric conductivity in lengthwise direction, was within 1.0 IACS % in all materials.

The materials H~M capable of being extruded at a given extrusion velocity were investigated for tensile characteristics, anti-corrosive property, and workability. The Table 14 shows the results.

TABLE 14

| | Alloy | Possibility or impossibility of extrusion | Tensile performance: TS (N/mm²) | YS (N/mm²) | El (%) | Anti-corrosive property (CASS 200 h): Non-welding portion | Welding portion | Processing workability (Bending, bead): Bending processing | Bead processing |
|---|---|---|---|---|---|---|---|---|---|
| Example of the present invention | H | possible | 97 | 37 | 40 | ○ | ○ | ○ | ○ |
| Example of the present invention | I | possible | 118 | 49 | 44 | ○ | ○ | ○ | ○ |
| Example of the present invention | J | possible | 112 | 44 | 43 | ○ | ○ | ○ | ○ |
| Example of the present invention | K | possible | 102 | 40 | 41 | ○ | ○ | ○ | ○ |
| Comparative Example | L | possible | 89 | 28 | 45 | ○ | ○ | Some surface roughening generated | Dimensional error existed |
| Example of the present invention | M | possible | 116 | 44 | 42 | ○ | ○ | ○ | ○ |
| Comparative Example | N | impossible | — | — | — | — | — | — | — |
| Comparative Example | O | impossible | — | — | — | — | — | — | — |
| Comparative Example | P | impossible | — | — | — | — | — | — | — |
| The current material | | possible | 95~125 | 35 or more | 30 or more | — | ○ | ○ | ○ |

In view of Table 14, the tensile characteristics of each test examples of the present invention with the exception of the alloy L (Comparative Example) was at least the same as those of the current pipe materials. The alloy L was small in the amount of Mg so that its tensile strength (TS) and 0.2% yielding strength (YS) were of low values.

The anti-corrosive property was evaluated according to 200 hrs. CASS test for samples of individual portions in lengthwise direction of the extruded pipe materials. As the results, corrosive conditions to be taken up particularly as a problem were not found in both of the welding portions and non-welding portions of all extruded pipe materials of the alloys H~M. In the welding portions, ΔEC were all lower than 1 IACS % and preferential corrosion in all the welding portions was null or in a level of less problem.

The bending workability and the terminal processing workability (shaft seal bead processing: Type B of FIG. 2(B)) was investigated respectively for several products. Except the alloy L, all could be processed soundly. The alloy L generated surface roughening in bending processing and dimensional errors in terminal processing. This shows that the pipe material is slightly soft and not suited as a pipe for air conditions of automobiles.

In view of the foregoing, pipe materials obtained by applying the alloys H~K and M for use in the present invention to the homogenizing treatment of the present invention and thereafter extruding them by way of port hole extrusion are furnished with characteristics and workability required for pipes of air conditioners for automobiles and are fully applicable as pipes for air conditioners of automobiles.

On the other hand, the alloys L, N, O and P are not operable for port hole extrusion or can be extruded but with a very low speed, thus lacking practical utilization.

Industrial Applicability

The hollow materials of the present invention show no difference in structure (the amount of precipitation of Mn, etc.) between the welding portions and non-welding portions in port hole extrusion and are prevented from preferential corrosion in the welding portions, thus making the materials suited as constructive materials. The process for producing the hollow materials of the present invention is suitable as a process for easily producing the aforesaid hollow materials wherein an ingot is subjected to a given homogenizing treatment thereby having Mn precipitated as a coarse compound.

Further, the extruded pipe materials of the present invention are preferable as an aluminum alloy port hole extruded pipe materials for pipes for air conditioners, which are improved in preferential corrosion of the welding portions. The process for producing the extruded pipe materials of the present invention is suitable as a process for easily producing the aforesaid extruded pipe materials wherein an ingot is subjected to a given homogenizing treatment to have compounds containing Mn as an alloy element precipitated coarsely.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A process for producing an aluminum alloy hollow material comprising:

homogenizing an aluminum alloy ingot containing about 0.8 to about 1.5 wt % Mn; and port hole extruding the ingot to produce a hollow material, wherein said homogenizing of the ingot is carried out by maintaining the ingot at a first temperature of 500–630° C. for more than zero but not more than about 24 hours, cooling the ingot down to a second temperature of 400–500° C. at a cooling velocity of not more than 100° C./hr, and maintaining the ingot at said second temperature for about 4 to 48 hours, wherein the processing is performed such that a difference in electric conductivity of individual portions in a lengthwise direction of the hollow material is not more than 1.0 IACS %, and such that an electric conductivity value becomes at least 39.0 IACS %.

2. A process for producing an aluminum alloy hollow material as claimed in claim 1, further comprising drawing-elongating following said port hole extruding.

3. A process for producing an aluminum alloy hollow material, comprising:

homogenizing an aluminum alloy ingot containing about 0.8 to about 1.5 wt % Mn;

wherein said homogenizing of the ingot is carried out by raising the ingot to a temperature (T1) of 500–630° C., maintaining said ingot at said temperature T1 for more than zero but not more than about 16 hours, cooling the ingot from the temperature T1 to 350° C. (T2) at a cooling velocity of not more than 100° C./hr, wherein the time between reaching the temperature T1 to reaching the temperature T2 is maintained within 10–48 hrs, and cooling the ingot at an optional cooling velocity from the temperature T2 to room temperature; and port hole extruding the ingot to produce a hollow material, wherein the processing is performed such that a difference in electric conductivity of individual portions in a lengthwise direction of the hollow material is not more than 1.0 IACS %, and such that an electric conductivity value becomes at least 39.0 IACS %.

4. A process for producing an aluminum alloy hollow material as claimed in claim 3, further comprising drawing-elongating following said port hole extruding.

5. A process for producing an aluminum alloy hollow material, comprising:

homogenizing an aluminum alloy ingot containing about 0.3 to about 1.5 wt % Mn; and port hole extruding the ingot to produce a hollow material;

wherein said homogenizing of the ingot is carried out by maintaining the ingot at a temperature of 400–500° C. for 0.5–4 hours, elevating the temperature up to 550–630° C., maintaining the temperature for 0.5–4 hrs., cooling the ingot to 350° C. at a cooling velocity of not more than 100° C./hr, and cooling the ingot from 350° C. to room temperature at an optional cooling rate.

6. A process for producing an aluminum alloy hollow material as claimed in claim 5, further comprising drawing-elongating following said port hole extruding.

7. The process of claim 5, wherein the processing is performed such that a difference in electric conductivity of individual portions in a lengthwise direction of the pipe material is not more that 1.0 IACS %.

8. A process for producing an aluminum alloy extruded pipe material for air conditioner piping wherein an aluminum alloy ingot consisting of 0.8–1.5 wt % Mn, 0.1–0.7 wt % Fe, 0.03–0.6 wt % Si, and 1 or at least 2 of 0.00–0.45 wt % Cu, 0.0–0.3 wt % Mg, 0.0–0.3 wt % Cr, 0.0–0.1 wt % Ti, 0.0–0.5 wt % Zn, 0.0–0.3 wt % Zr, and 0.0–0.3 wt % Ni, the balance being aluminum, and any unavoidable impurities, that is excellent in the effect of preventing preferential corrosion, comprising:

homogenizing the aluminum alloy ingot; and port hole extruding the ingot to produce a pipe material, wherein said homogenizing of the ingot is carried out by maintaining the ingot at a first temperature of 500–630° C. for more than zero but not more than about 24 hours, cooling the ingot down to a second temperature of about 400–500° C. at a cooling velocity of not more than 100° C./hr, and maintaining the ingot at said second temperature for about 4 to 48 hours, wherein the processing is performed such that a difference in electric conductivity of individual portions in a lengthwise direction of the pipe material is not more than 1.0 IACS %, and such that an electric conductivity value becomes at least 39.0 LACS %.

9. A process for producing an aluminum alloy extruded pipe material for air conditioner piping wherein an aluminum alloy ingot consisting of 0.8–1.5 wt % Mn, 0.1–0.7 wt % Fe, 0.03–0.6 wt % Si, and 1 or at least 2 of 0.00–0.45 wt % Cu, 0.0–0.3 wt % Mg, 0.0–0.3 wt % Cr, 0.0–0.1 wt % Ti, 0.0–0.5 wt % Zn, 0.0–0.3 wt % Zr, and 0.0–0.3 wt % Ni, the balance being aluminum, and any unavoidable impurities, that is excellent in the effect of preventing preferential corrosion, comprising:

homogenizing the aluminum alloy ingot;

wherein said homogenizing of the ingot is carried out by raising the ingot to a temperature (T1) of 500–630° C., maintaining said ingot at said temperature T1 for more than zero but not more than about 48 hours, cooling the ingot from the temperature T1 to 350° C. (T2) at a cooling velocity of not more than 100° C./hr, wherein the time between reaching the temperature T1 to reaching the temperature T2 is maintained within 12–48 hrs, and cooling the ingot at an optional cooling velocity from the temperature T2 to room temperature; and port hole extruding the ingot to produce a pipe material, wherein the processing is performed such that a difference in electric conductivity of individual portions in a lengthwise direction of the pipe material is not more than 1.0 IACS %, and such that an electric conductivity value becomes at least 39.0 IACS %.

10. A process for producing an aluminum alloy extruded pipe material for air conditioner piping wherein an aluminum alloy ingot consisting of 0.8–1.5 wt % Mn, 0.1–0.7 wt % Fe, 0.03–0.6 wt % Si, and 1 or at least 2 of 0.00–0.45 wt % Cu,0.0–0.3 wt % Mg, 0.0–0.3 wt % Cr, 0.0–0.1 wt % Ti, 0.0–0.5 wt % Zn, 0.0–0.3 wt % Zr, and 0.0–0.3 wt % Ni, the balance being aluminum, and any unavoidable impurities, comprising:

homogenizing the aluminum alloy ingot; and port hole extruding the ingot to produce a pipe material;

wherein said homogenizing of the ingot is carried out by maintaining the ingot at a temperature of 400–500° C. for 0.5–4 hours, elevating the temperature up to 550–630° C., maintaining the temperature for 0.5–4 hrs., cooling the ingot to 350° C. at a cooling velocity of not more than 100° C./hr, and cooling the ingot from 350° C. to room temperature at an optional cooling velocity.

11. A process for producing an aluminum alloy hollow material as claimed in claim 10, wherein the processing is performed such that an electric conductivity of the pipe material is at least 39.0 IACS %.

12. The process of claim 10, wherein the processing is performed such that a difference in electric conductivity of individual portion in a lengthwise direction of the pipe material is not more than 1.0 IACS %.

13. A process for producing an aluminum alloy drawn pipe for heat exchanger piping, wherein the aluminum alloy ingot consists of 0.8–1.5 wt % Mn, 0.1–0.7wt % Fe, and 0.03–0.6wt % Si, and 1 or at least 2 of 0.00–0.45wt % Cu, 0.0–0.3wt % Mg, 0.0–0.3wt % Cr, 0.0–0.1 wt % Ti, 0.0–0.5wt % Zn, 0.0–0.3 wt % Zr and 0.00–0.3 wt % Ni, the balance being aluminum, and any unavoidable impurities, and wherein the effect of preventing preferential corrosion and the effect of preventing the surface fine striation of the drawn pipe are excellent, and drawing is conducted additionally after extrusion, comprising:

homogenizing the aluminum alloy ingot; and wherein drawing is conducted after extrusion of port hole to manufacture pipe material, wherein said homogenizing of the ingot is carried out by maintaining the ingot at a first temperature of 500–630° C. for more than zero but not more than 24 hours, cooling the ingot down to a second temperature of about 400–500° C. at a cooling velocity of not more than 100° C./h, and maintaining the ingot at said second temperature for about 4 to 48 hours, wherein the processing is performed such that a difference in electric conductivity of individual portions in a lengthwise direction of the hollow material is not more than 1 IACS %, and such that an electric conductivity value becomes at least 39.0 IACS%.

14. A process for producing an aluminum alloy drawn pipe for heat exchanger piping, wherein the aluminum alloy ingot consists of 0.8–1.5wt % Mn, 0.1–0.7wt % Fe, and 0.03–0.6wt % Si, and 1 or at least 2 of 0.00–0.45 wt % Cu, 0.0–0.3 wt % Mg, 0.0–0.3 wt % Cr, 0.0–0.1 wt % Ti, 0.0–0.5 wt % Zn, 0.0–0.3 wt % Zr and 0.0–0.3 wt % Ni, the balance being aluminum, and any unavoidable impurities, and wherein the effect of preventing preferential corrosion and the effect of preventing fine striations on the surface of drawn pipe are excellent, and drawing is conducted additionally after extrusion, comprising:

homogenizing the aluminum alloy ingot;

wherein drawing is conducted after extrusion of port hole to manufacture pipe material, wherein said homogenizing of the ingot is carried out by raising the ingot to a temperature (T1) of 500–630° C., maintaining said ingot at said temperature T1 for more than zero but not more than about 16 hours, cooling the ingot down to a second temperature of 350° C. (T2) at a cooling velocity of not more than 100° C./h, wherein the time between reaching the temperature T1 to reaching the temperature T2 is maintained within 10–48 hrs, and cooling the ingot at an optional cooling velocity from the temperature T2 to room temperature; and port hole extruding the ingot to produce a hollow material, wherein the processing is performed such that a difference in electric conductivity of individual portions in a lengthwise direction of the hollow material is not more than 1 IACS %, and such that an electric conductivity value becomes at least 39.0 IACS%.

15. A process for producing an aluminum alloy material for heat exchanger piping, wherein the aluminum alloy ingot consists of 0.8–1.5 wt % Mn, 0.1–0.7 wt % Fe, and 0.03–0.6 wt % Si, and 1 or at least 2 of 0.00–0.45 wt % Cu, 0.0–0.3 wt % Mg, 0.0—0.3 wt % Cr, 0.0–0.1 wt % Ti, 0.0–0.5 wt % Zn, 0.0–0.3 wt % Zr and 0.0–0.3 wt % Ni, the balance being aluminum, and any unavoidable impurities, and wherein the effect of preventing preferential corrosion and the plasticity at the time of forming by form-rolling are excellent, and form-rolling is additionally conducted after extrusion and drawing, comprising:

homogenizing the aluminum alloy ingot;

wherein drawing is conducted after extrusion of port hole to manufacture pipe material, wherein said homogenizing of the ingot is carried out by maintaining the ingot at a first temperature of 500–630° C. for more than zero but not more than 24 hours, cooling the ingot down to a second temperature of about 400–500° C. at a cooling velocity of not more than 100° C./h, and maintaining the ingot at said second temperature for about 4 to 48 hours, wherein the processing is performed such that a difference in electric conductivity of individual portions in a lengthwise direction of the hollow material is not more than 1 IACS %, and such that an electric conductivity value becomes at least 39.0 IACS%.

16. A process for producing an aluminum alloy material for heat exchanger piping, wherein the aluminum alloy ingot consists of 0.8–1.5 wt % Mn, 0.1–0.7 wt % Fe, and 0.03–0.6 wt % Si, and 1 or at least 2 of 0.00–0.45 wt % Cu, 0.0–0.3 wt % Mg, 0.0–0.3 wt % Cr, 0.0–0.1 wt % Ti, 0.0–0.5 wt % Zn, 0.0–0.3 wt % Zr and 0.0–0.3 wt % Ni, the balance being aluminum, and any unavoidable impurities, and wherein the effect of preventing preferential corrosion and the plasticity at the time of forming by form-rolling are excellent, and form-rolling is additionally conducted after extrusion and drawing, comprising:

homogenizing the aluminum alloy ingot;

wherein drawing is conducted after extrusion of port hole to manufacture pipe material, wherein said homogenizing of the ingot is carried out by raising the ingot to a temperature (T1) of 500–630° C., maintaining said ingot at said temperature of T1 for more than zero but not more than about 16 hours, cooling the ingot down to a second temperature of 350° C. (T2) at a cooling velocity of not more than 100° C./h, wherein the time between reaching the temperature T1 to reaching the temperature T2 is maintained within 10–48 hrs, and cooling the ingot at an optional cooling velocity from the temperature T2 to room temperature; and port hole extruding the ingot to produce a hollow material, wherein the processing is performed such that a difference in electric conductivity of individual portions in a lengthwise direction of the hollow material is not more than 1 IACS %, and such that an electric conductivity value becomes at least 39.0 IACS %.

17. A method of preventing striations in drawn extruded hollow material, the method comprising:

homogenizing an aluminum alloy ingot consisting of 0.8–1.5 wt % Mn, 0.1–0.7 wt % Fe, and 0.03–0.6 wt % Si, and 1 or at least 2 of 0.00–0.45 wt % Cu, 0.0–0.3 wt % Mg, 0.0–0.3 wt % Cr, 0.0–0.1 wt % Ti, 0.0–0.5 wt % Zn, 0.0–0.3 wt % Zr and 0.0–0.3 wt % Ni, the balance being aluminum and any unavoidable impurities;

wherein said homogenizing of the aluminum allayingot is carried out by raising the ingot to a temperature (T1) of 500–630° C., maintaining said ingot at said temperature T1 for more than zero but not more than about 16 hours, cooling the ingot down to a second temperature of 350° C. (T2) at a cooling velocity of not more than 100° C. Th, wherein the time between reaching the temperature T1 to reaching the temperature T2 is maintained within 10–48 hrs, and cooling the ingot at an optional cooling velocity from the temperature T2 to room temperature; and port hole extruding the ingot to produce a hollow material; and drawing the material to manufacture pipe material that is substantially free of surface striations;

wherein the processing is performed such that a difference in electric conductivity of individual portions in a lengthwise direction of the hollow material is not more than 1 IACS %, and such that an electric conductivity value becomes at least 39.0 IACS%.

* * * * *

UNITED STATES PATENT AND TRADEMARK OFFICE

CERTIFICATE OF CORRECTION

PATENT NO. : 6,908,520 B2
DATED : June 21, 2005
INVENTOR(S) : Taguchi et al.

It is certified that error appears in the above-identified patent and that said Letters Patent is hereby corrected as shown below:

Column 35,
Line 65, after “material” insert -- , --.

Column 36,
Line 60, delete “that” and insert, -- than --.

Column 37,
Line 16, delete “LACS%” and insert therefore -- IACS% --.

Column 38,
Line 1, delete “portion” and insert therefore -- portions --.

Column 40,
Line 20, delete “allayingot” and insert therefore, -- alloy ingot --.
Line 26, delete “100º C. Th” and insert therefore, -- 100º C./h --.

Signed and Sealed this

Twenty-ninth Day of November, 2005

JON W. DUDAS
*Director of the United States Patent and Trademark Office*